US010434764B1

(12) United States Patent
Tal

(10) Patent No.: US 10,434,764 B1
(45) Date of Patent: Oct. 8, 2019

(54) YAW MEASUREMENT BY SPECTRAL ANALYSIS

(71) Applicant: LANDA CORPORATION LTD., Rehovot (IL)

(72) Inventor: David Tal, Rehovot (IL)

(73) Assignee: LANDA CORPORATION LTD., Rehovot (IL)

( * ) Notice: Subject to any disclaimer, the term of this patent is extended or adjusted under 35 U.S.C. 154(b) by 0 days.

(21) Appl. No.: 16/122,943

(22) Filed: Sep. 6, 2018

Related U.S. Application Data

(60) Provisional application No. 62/554,596, filed on Sep. 6, 2017.

(51) Int. Cl.
*B41J 2/045* (2006.01)

(52) U.S. Cl.
CPC ..... *B41J 2/04505* (2013.01); *B41J 2/04586* (2013.01)

(58) Field of Classification Search
CPC ..... B41J 2/04505; B41J 2/04586
See application file for complete search history.

(56) References Cited

U.S. PATENT DOCUMENTS

| | | | |
|---|---|---|---|
| 3,697,568 | A | 10/1972 | Boissieras et al. |
| 4,190,844 | A | 2/1980 | Taylor |
| 5,517,214 | A | 5/1996 | Bhatia et al. |
| 5,528,271 | A | 6/1996 | Ebisawa et al. |
| 5,532,314 | A | 7/1996 | Sexsmith et al. |
| 6,081,281 | A | 6/2000 | Cleary et al. |
| 6,220,693 | B1 | 4/2001 | Bode et al. |
| 6,293,196 | B1 | 9/2001 | DeMoore et al. |
| 6,491,364 | B2 | 12/2002 | Pietrzyk |
| 7,915,091 | B2 | 3/2011 | Chew et al. |
| 7,988,247 | B2 | 8/2011 | Letendre et al. |
| 8,038,284 | B2 | 10/2011 | Hori et al. |
| 9,272,511 | B2 | 3/2016 | Menzel et al. |
| 9,284,469 | B2 | 3/2016 | Song et al. |
| 9,381,740 | B2 | 7/2016 | Hoisington et al. |
| 9,539,817 | B2 | 1/2017 | Condello et al. |
| 2002/0046670 | A1 | 4/2002 | Crystal et al. |
| 2003/0016264 | A1 | 1/2003 | Jeanmaire |
| 2006/0132525 | A1 | 6/2006 | Walmsley et al. |
| 2006/0164450 | A1 | 7/2006 | Hoisington et al. |

(Continued)

FOREIGN PATENT DOCUMENTS

| | | | |
|---|---|---|---|
| GB | 1443679 | A | 7/1976 |
| GB | 2374834 | A | 10/2002 |

(Continued)

OTHER PUBLICATIONS

Co-pending U.S. Appl. No. 16/244,145, filed Jan. 10, 2019.

(Continued)

*Primary Examiner* — Sharon A. Polk
(74) *Attorney, Agent, or Firm* — Marc Van Dyke; Fourth Dimension IP

(57) ABSTRACT

Some embodiments relate to a method of measuring a magnitude of a yaw angle of print head(s) or of a supporting print-bar thereof relative to cross-print direction. In some embodiments, a 1D-representation (1D-rep) of an ink-calibration image is transformed into the frequency domain (e.g. by FFT) characterized by peak profile. The yaw angle magnitude may be computed from relative energies of a primary and secondary peak of the peak profile of the frequency domain.

20 Claims, 21 Drawing Sheets

(56) References Cited

U.S. PATENT DOCUMENTS

| | | | |
|---|---|---|---|
| 2006/0164454 | A1 | 7/2006 | Walmsley et al. |
| 2007/0054981 | A1 | 3/2007 | Yanagi et al. |
| 2007/0057979 | A1 | 3/2007 | Gardner et al. |
| 2008/0084465 | A1 | 4/2008 | Telken et al. |
| 2008/0122883 | A1 | 5/2008 | Walmsley et al. |
| 2008/0129768 | A1 | 6/2008 | Walmsley et al. |
| 2009/0085941 | A1 | 4/2009 | Walmsley et al. |
| 2009/0115825 | A1 | 5/2009 | Peng et al. |
| 2009/0244180 | A1 | 10/2009 | Panchawagh et al. |
| 2009/0295855 | A1 | 12/2009 | Walmsley et al. |
| 2010/0060703 | A1 | 3/2010 | Ohara et al. |
| 2011/0304868 | A1 | 12/2011 | Ohnishi |
| 2012/0013693 | A1 | 1/2012 | Tasaka et al. |
| 2012/0050410 | A1 | 3/2012 | Kwok |
| 2012/0156624 | A1 | 6/2012 | Rondon et al. |
| 2014/0168313 | A1 | 6/2014 | Ramesh et al. |
| 2018/0201038 | A1 | 7/2018 | Karlinski et al. |

FOREIGN PATENT DOCUMENTS

| | | | |
|---|---|---|---|
| GB | 2518148 | A | 3/2015 |
| JP | S6076343 | A | 4/1985 |
| JP | 2017047536 | A | 3/2017 |
| RU | 2180675 | C2 | 3/2002 |
| RU | 2282643 | C1 | 8/2006 |
| WO | 9604339 | A1 | 2/1996 |
| WO | 9942509 | A1 | 8/1999 |
| WO | 0064685 | A1 | 11/2000 |
| WO | 02094912 | A1 | 11/2002 |
| WO | 2010042784 | A3 | 7/2010 |
| WO | 2013132418 | A2 | 9/2013 |
| WO | 2013132424 | A1 | 9/2013 |

OTHER PUBLICATIONS

Dimatix Fujifilm., "Samba Basic YAW and Stitch Procedures," 4 pages.

JP2017047536A Machine Translation (by Google Patents)—published Mar. 9, 2017; Seiko Epson Corp.

JPS6076343A Machine Translation (by EPO and Google)—published Apr. 30, 1985; Toray Industries.

PIAS®-II Spec Sheet, Nov. 13, 2018, 12 pages.

RU2180675 Machine Translation (by EPO and Google)—published Mar. 20, 2002; Zao Rezinotekhnika.

RU2282643 Machine Translation (by EPO and Google)—published Aug. 27, 2006; Balakovorezinotekhnika Aoot.

YAW MEASUREMENT BY SPECTRAL ANALYSIS

CROSS-REFERENCE TO RELATED APPLICATIONS

The present application claims priority to U.S. Provisional Application No. 62/554,596 filed on Sep. 6, 2017, which is incorporated by reference herein in its entirety.

BACKGROUND

The following issued patents and patent publications provide potentially relevant background material, and are all incorporated by reference in their entirety: US 20160369119; US 20160344896; US 20160297978; US 20160297190; US 20160222232; US 20160207341; US 20160207306; US 20160200097; US 20160167363; US 20160075130; US 20150165759; US 20150118503; US 20150072090; US 20150054865; US 20150049134; US 20150044437; US 20150044431; US 20150042736; US 20150025179; US 20150024648; US 20150024180; US 20150022602; and US 20150015650.

SUMMARY

A method of measuring a magnitude of a yaw angle of print head(s) or of a supporting print-bar thereof relative to cross-print direction comprising: a. depositing ink droplets from print head(s) of the print-bar onto a target surface to form a calibration ink-image thereon; b. optically imaging the calibration ink-image to acquire a 2D digital calibration image; c. computing a 1D-representation (1D-rep) of the 2D digital calibration image by averaging the 2D digital calibration image in a pre-determined direction; d. transforming the 1D-rep into a frequency domain representation characterized by a peak profile; e. analyzing the frequency domain representation to compute an energy magnitude(s) of one or more secondary peaks of the peak profile; and f. computing a measured yaw angle magnitude from the energy magnitude(s) of the secondary peak(s).

In some embodiments, the measured yaw angle magnitude is computed from the combination of (A) the energy magnitude(s) of the secondary peak(s) and (B) a yaw:peak-energy correlation function between yaw magnitudes and absolute or relative secondary peak energy values.

A method of measuring a magnitude of a yaw angle of print head(s) or of a supporting print-bar thereof relative to cross-print direction comprising: a. depositing ink droplets from print head(s) of the print-bar onto a target surface to form a calibration ink-image thereon; b. optically imaging the calibration ink-image to acquire a 2D digital calibration image; c. computing a 1D-representation (1D-rep) of the 2D digital calibration image by averaging the 2D digital calibration image in a pre-determined direction; d. transforming the 1D-rep into a frequency domain representation characterized by a peak profile; e. analyzing the frequency domain representation to compute an energy magnitude(s) of one or more secondary peaks of the peak profile; and f. adjusting a yaw of the print head or of a supporting print bar thereof by an adjustment angle that is computed from the energy magnitude(s) of the one of more secondary peak(s).

In some embodiments, the adjustment angle by which the print head or print bar is adjusted is computed from the combination of the (A) the energy magnitude(s) of the secondary peak(s) and (B) the yaw:peak-energy correlation function.

In some embodiments, a measured yaw angle magnitude is computed from the energy magnitude(s) of the secondary peak(s), and the adjustment angle is computed to have a magnitude matching the measured yaw angle magnitude.

In some embodiments, the transforming of the 1D-rep into the frequency domain representation comprises subjecting the 1D-rep to a fast Fourier transformation (FFT).

In some embodiments, (i) a parameter describing relative energy-magnitudes of two or more secondary peaks is computed from the peak profile and (ii) the yaw angle magnitude is measured and/or the yaw of the print head is adjusted according to the parameter describing the relative energy-magnitudes.

In some embodiments, the parameter describing the relative energy-magnitudes is a ratio between respective energies of first and second secondary peaks of the peak profile.

In some embodiments, the calibration ink-image is formed by printing a digital input image.

In some embodiments, the digital input image comprises a plurality of parallel lines.

In some embodiments, the pre-determined direction is the print direction.

In some embodiments, the calibration ink-image is optically imaged on the target surface.

In some embodiments, the calibration ink-image is optically imaged after being transferred away from the target surface.

A printing system comprising: a. at least one of (i) an intermediate transfer member (ITM); (ii) a support thereof and (iii) a substrate-transport system (STS), the ITM or support thereof or the STS defining print and cross-print directions for the printing system; b. an image-forming station comprising at least one print bar that is configured, when loaded with a print head, to deposit ink droplets onto a target surface to form a calibration image thereon, c. imaging apparatus for optically imaging the calibration ink-image to acquire a 2D digital calibration image; d. data-processing circuitry for: i. computing a 1D-representation (1D-rep) of the 2D digital calibration image by averaging the 2D digital calibration image in a pre-determined direction; ii. transforming the 1D-rep into a frequency domain representation characterized by a peak profile; iii. analyzing the frequency domain representation to compute an energy magnitude(s) of one or more secondary peaks of the peak profile; and iv. computing a measured yaw angle magnitude from the energy magnitude(s) of the secondary peak(s).

A printing system comprising: a. at least one of (i) an intermediate transfer member (ITM); (ii) a support thereof and (iii) a substrate-transport system (STS), the ITM or support thereof or the STS defining print and cross-print directions for the printing system; b. an image-forming station comprising at least one print bar that is configured, when loaded with a print head, to deposit ink droplets onto a target surface to form a calibration image thereon, c. imaging apparatus for optically imaging the calibration ink-image to acquire a 2D digital calibration image; d. data-processing circuitry for: i. computing a 1D-representation (1D-rep) of the 2D digital calibration image by averaging the 2D digital calibration image in a pre-determined direction; ii. transforming the 1D-rep into a frequency domain representation characterized by a peak profile; iii. analyzing the frequency domain representation to compute an energy magnitude(s) of one or more secondary peaks of the peak profile.

In some embodiments, the printing system further comprising: a mechanized rotation system responsive to output of the data-processing circuitry for automatically rotating the print bar or loaded print head by an adjustment angle that is computed, by the data-processing circuitry, from the energy magnitude(s) of the one or more secondary peak(s).

In some embodiments, the mechanized rotation system comprises at least one of an electrical motor and a servo.

In some embodiments, the target surface is selected from the group consisting of (i) an external surface of the ITM and (ii) substrate that is transported by the STS.

BRIEF DESCRIPTION OF THE DRAWINGS

FIGS. 8A-8C show the resulting ink-image for the following three situations.

Figure 1:
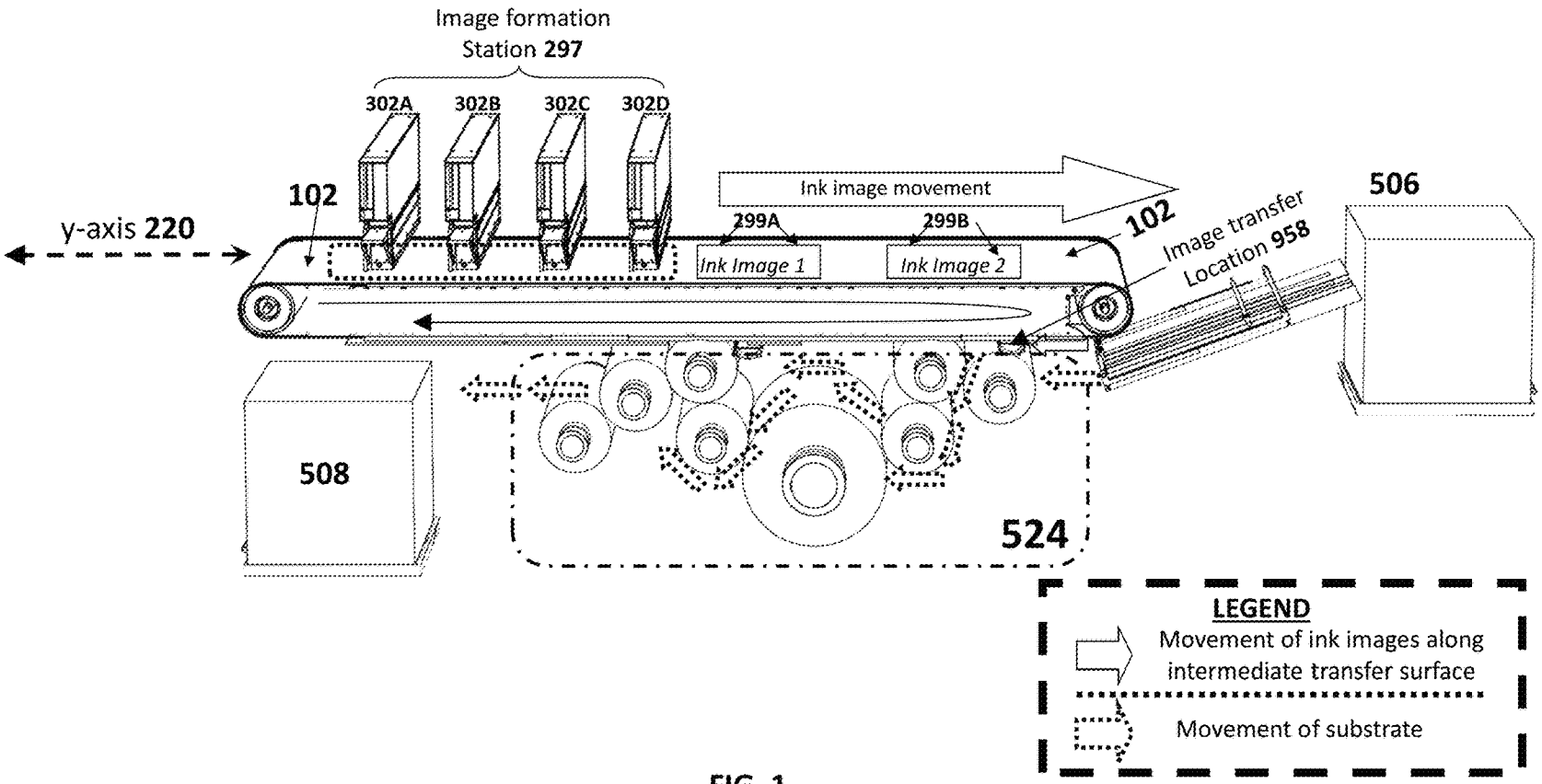
FIG. 1 illustrates a printing system where ink images are formed at an image forming station on the surface of an intermediate transfer member (ITM).

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate identical components but may not be referenced in the description of all figures.

DETAILED DESCRIPTION OF ILLUSTRATED EMBODIMENTS

FIG. 1 illustrates a printing system where ink images 299A, 299B are formed at an image forming station 297 on the surface of an intermediate transfer member (ITM) 102. Image forming station 297 comprises one or more print bars 302A, 302B, 302C, 302D—e.g. oriented along a cross-print direction that is perpendicular to the direction of movement of the ITM (i.e. print direction 220).

After formation at image formation station 297, the ink images 299 are transported along the external surface of the ITM 102 to an image transfer station 958 where the ink-images are transferred to substrate (e.g. web substrate or sheet substrate). In the non-limiting example of FIG. 1, sheet substrate from input supply 506 is transported by a substrate-transport-system (STS) 524 (i) to the image transfer station 958 and (ii) subsequently to an output stack 508 of substrate.

In the particular example of FIG. 1, the ITM 102 is a flexible blanket mounted over a plurality of rollers—however, in other embodiments the ITM 102 may be a drum. In yet other embodiments, the ink image may be printed directly onto substrate. Presently-disclosed teachings may be applied for any ink-jet printing system where an image is ink-jetted onto a target (e.g. ITM 102 or substrate) from one or more multi-nozzle print heads.

Figure 2:
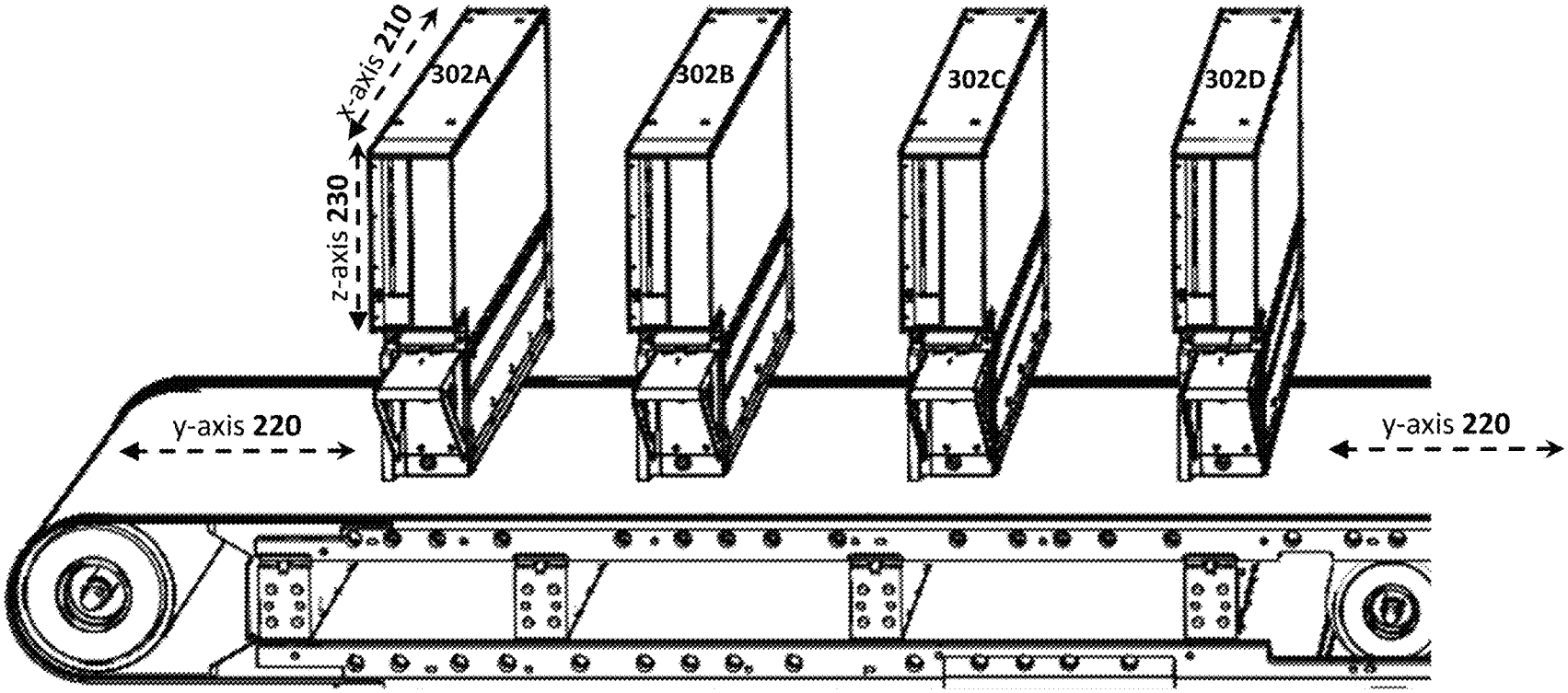
FIG. 2 is shows four print-bars over an ITM.

FIG. 2 illustrates the one or more print-bars 302A-302D. Ideally, and as shown in the example of FIG. 2, each print-bar (and each print-head thereof) is oriented in the cross-print direction defined by x-axis 210 which is perpendicular to the print-direction defined by y-axis 220. Also illustrated in FIG. 2 is z-axis 230 which is the vertical direction.

For the present disclosure, a 'target surface' is a surface to which an image is printed (i.e. by ink-jetting). In one example, the target surface is an ITM external surface. In another example, the target surface is substrate.

A 'print bar' 302 comprises one or more print-heads. As a target surface moves underneath the print bar, an ink-jet image is printed onto the target surface by print head(s) of the print bar by droplet deposition.

The 'print direction' is the direction of movement of a target surface (e.g. ITM or substrate) as the ink-jet image is deposited onto the target surface from the print-bar. A cross-print direction is the direction perpendicular to the print direction.

Figure 3A:
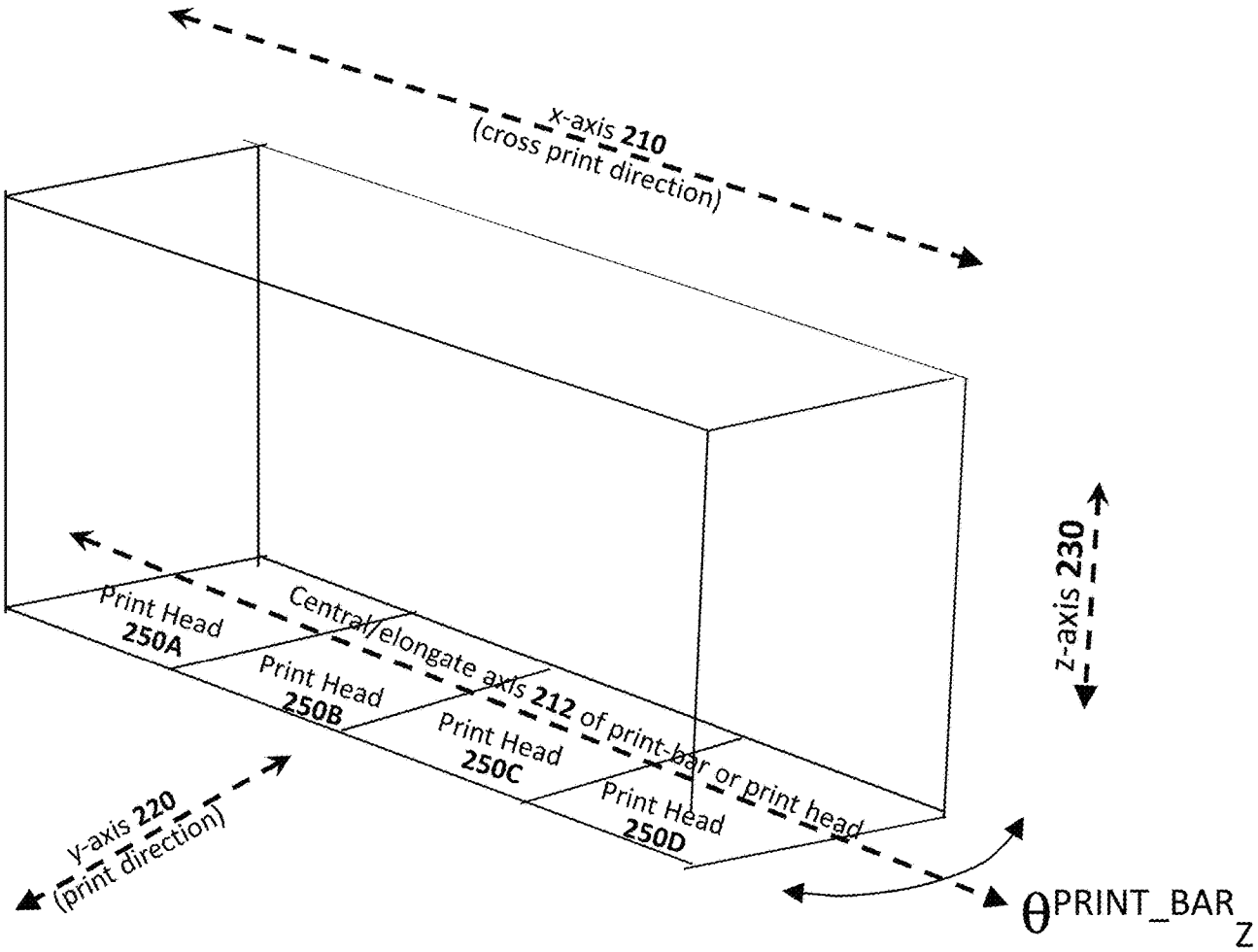
FIGS. 3A-3C schematically illustrates an example print-bar comprising multiple print heads.
Figure 3B:
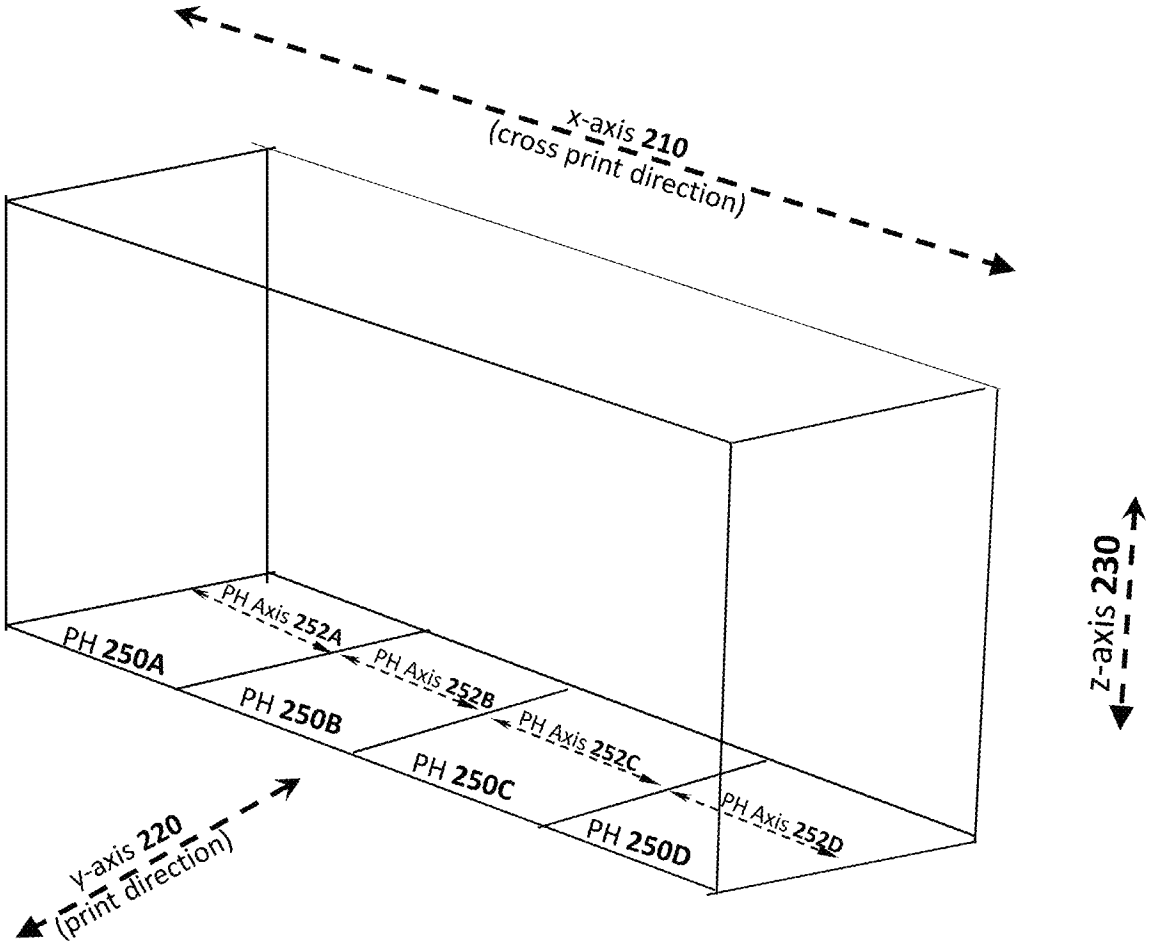

FIG. 3A schematically illustrates an example print-bar 302 comprising one or more print heads 250A-250D. The print bar 302 defines (i.e. by its geometry) a central or elongate axis thereof 212. Each print head 250A-250B also defines its own axis (see FIG. 3B where the print head axes are labelled 'PH Axis 252A-252D') which is typically along (or nearly along) the print bar central or elongate axis 212.

Also illustrated in FIG. 3A are the cross-print direction 210, the print direction 220 and the z-axis 230. The print bar 302 ideally is oriented perpendicular to the print direction 220—i.e. in the ideal situation, central or elongate axis 212 of the print bar 302 is parallel to (i.e. oriented along) the cross-print direction 210.

However, in practice there may be slight deviations—e.g. of up to a few radians. This deviation is the yaw angle $\theta^{PRINT_BA}{}_Z$ of the print bar and is shown in FIGS. 3A and 4A.

Figure 3C:
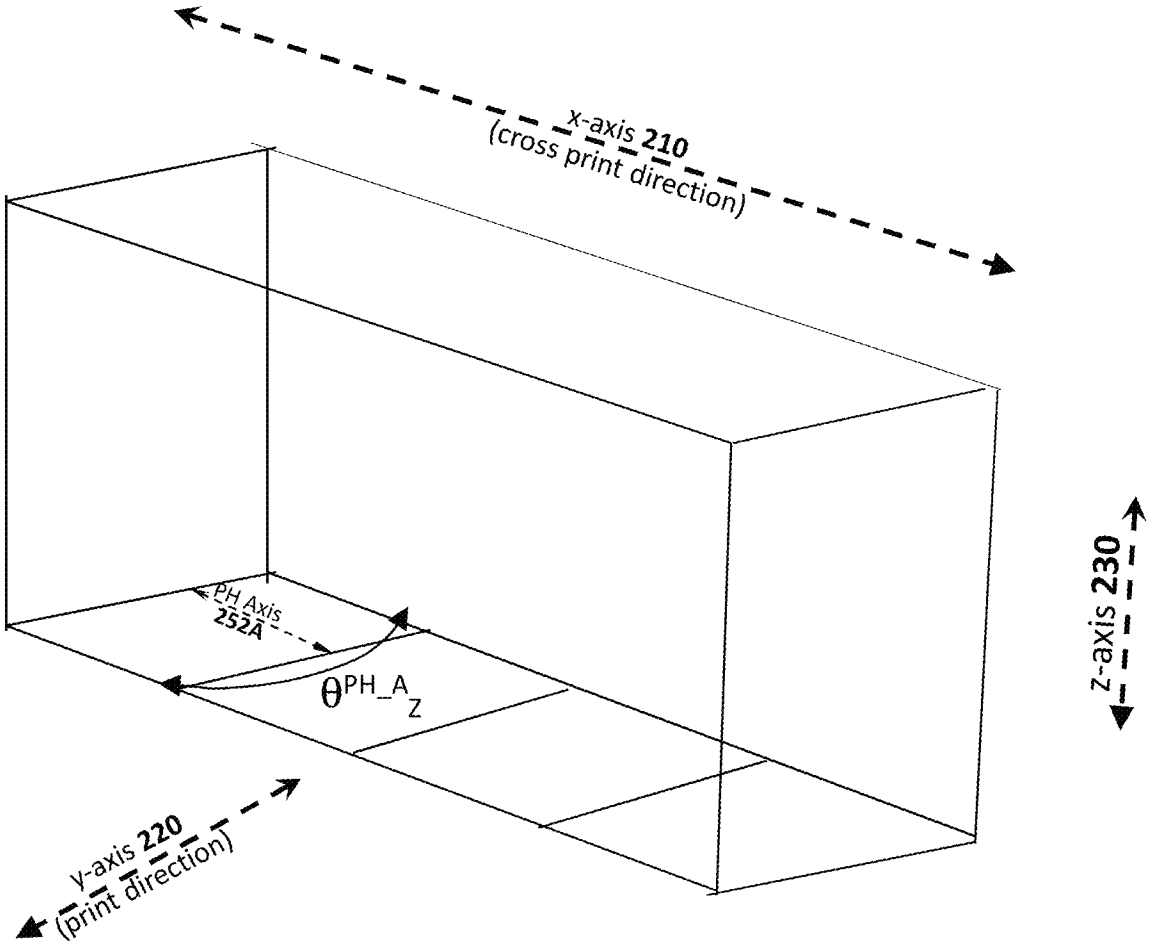

Similarly, under ideal circumstances, each print head 250A-250D is oriented so that each print bar axis 252A-252D is oriented perpendicular to the print direction 220 and along the cross-print direction 210. Unfortunately, this is not always the case—FIGS. 3C and 4B each illustrates the yaw angle $\theta^{PH_A}{}_Z$ for print head 250A. This is the yaw angle between (i) print head axis 252A of print head 250A and (ii) cross-print direction 210. Similar yaw angles (i.e. $\theta^{PH_B}{}_Z$ through $\theta^{PH_D}{}_Z$) may be defined the other print heads 250B-250C.

In situations where each print head 250A-250D is 'perfectly aligned' along its host print bar 302, there is no difference between (i) the yaw angles (i.e. $\theta^{PH_A}{}_Z$ through $\theta^{PH_D}{}_Z$) of each print head 250A-250D relative to the cross-print direction 210; and (ii) the yaw angle $\theta^{PRINT_BAR}{}_Z$ of the print bar 302 (i.e. its central or elongate axis 212) relative to cross-print direction 210. Throughout the present disclosure, any reference to a 'yaw angle' (or to $\theta_Z$) may refer either a print bar yaw angle $\theta^{PRINT_BAR}{}_Z$ or a print head yaw angle $\theta^{PH}{}_Z$ (e.g. any of $\theta^{PH_A}{}_Z$ through $\theta^{PH_D}{}_Z$). The presently disclosed techniques for measuring 'yaw angles' are equally applicable to print bar yaw angles or print head yaw angles.

Figure 4A:
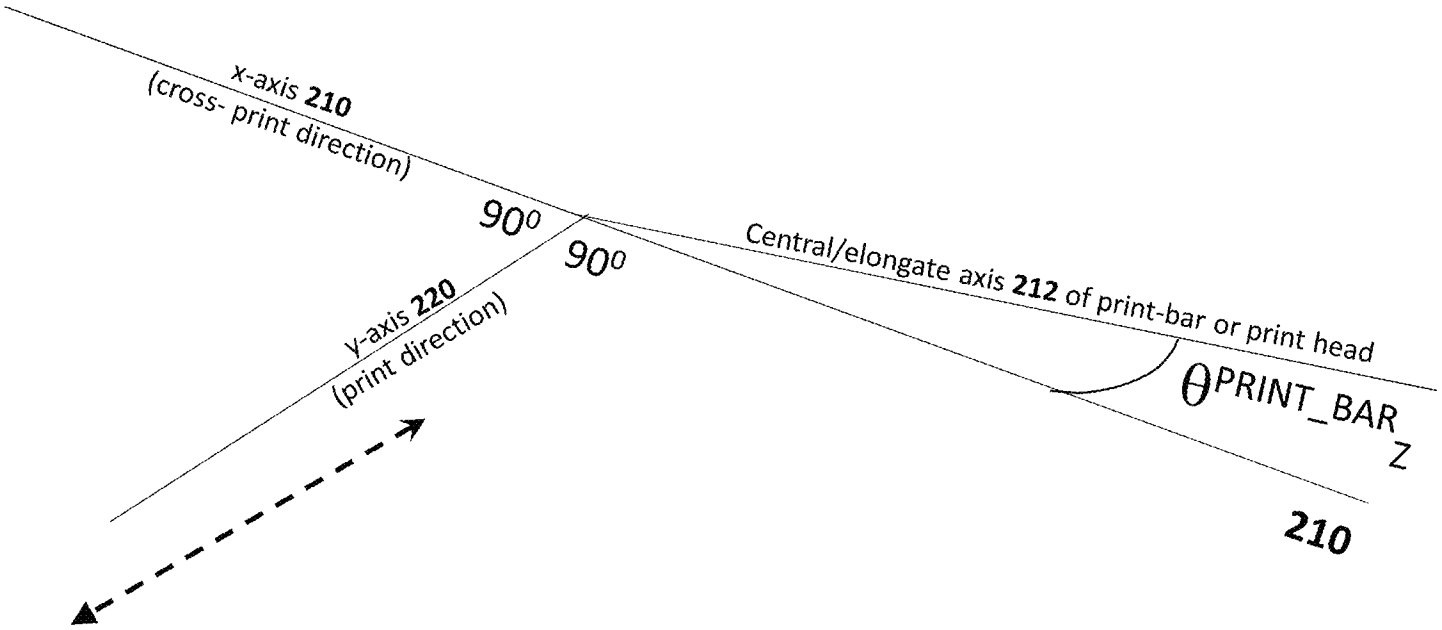
FIGS. 4A-4B illustrate lines and angles therebetween.
Figure 4B:
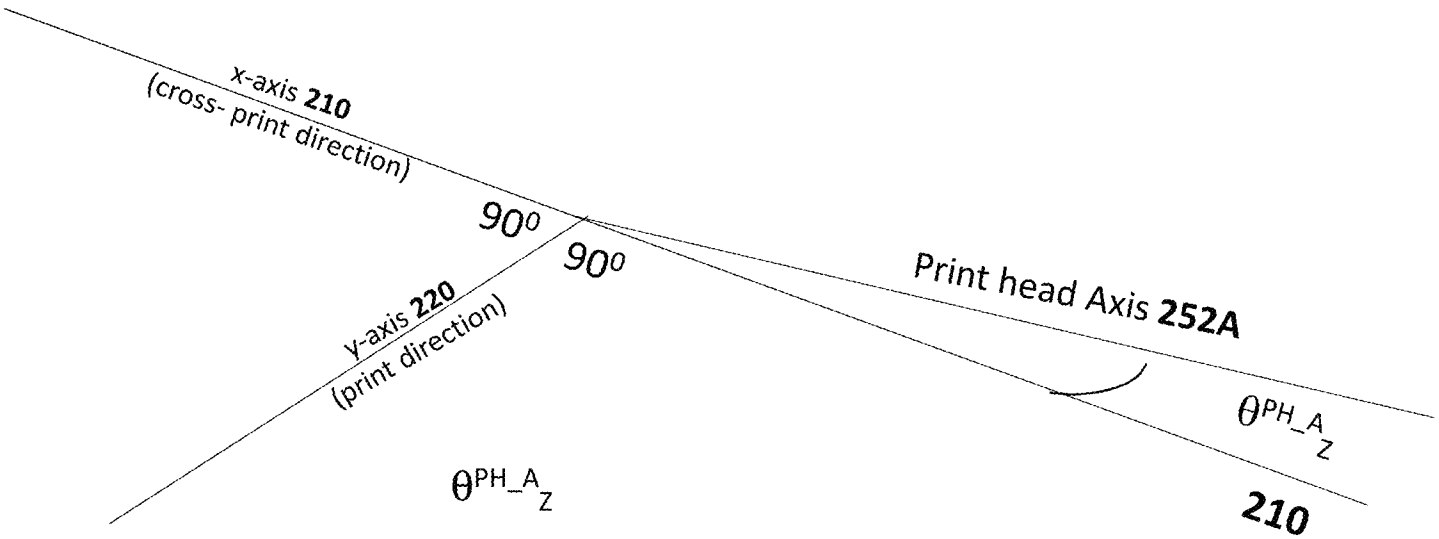

Reference is now made to FIG. 4A-4B. The print-bar 302 of FIG. 4A (or alternatively a print head 250 thereof—see FIG. 4B) define a central/elongate axis 212 that is body fixed—thus, as the print-bar 302 (or print head 250—see FIG. 4B) rotates (e.g. around a pivot point), the central/elongate axis 212 of print bar 302 (see FIG. 4A) (or print-head axis 252A of print head 250A) also rotates. In contrast, cross-print direction 210 is the direction perpendicular to print direction 220 and is not body-fixed to the print-bar 302 (or to a print head 250 thereof).

Embodiments of the present invention relate to methods and apparatus for measuring a Yaw angle $\theta_Z$, or at least magnitude/absolute value thereof. The Yaw angle $\theta_Z$ may be a print bar yaw angle $\theta^{PRINT_BAR}{}_Z$ or print head yaw angle $\theta^{PH}{}_Z$.

Figure 5A:
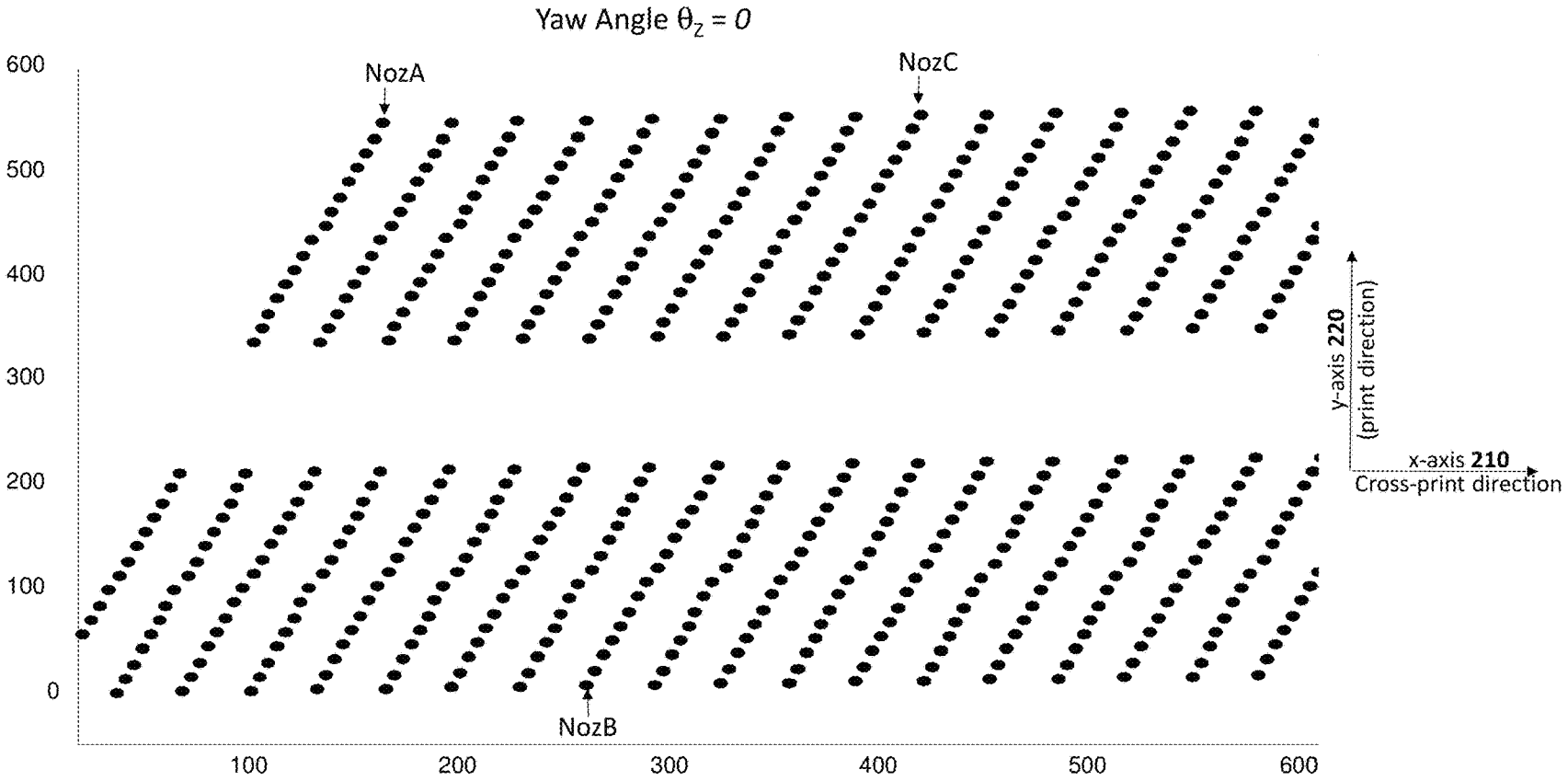
FIGS. 5A-5B illustrate nozzles of a print head.
Figure 5B:
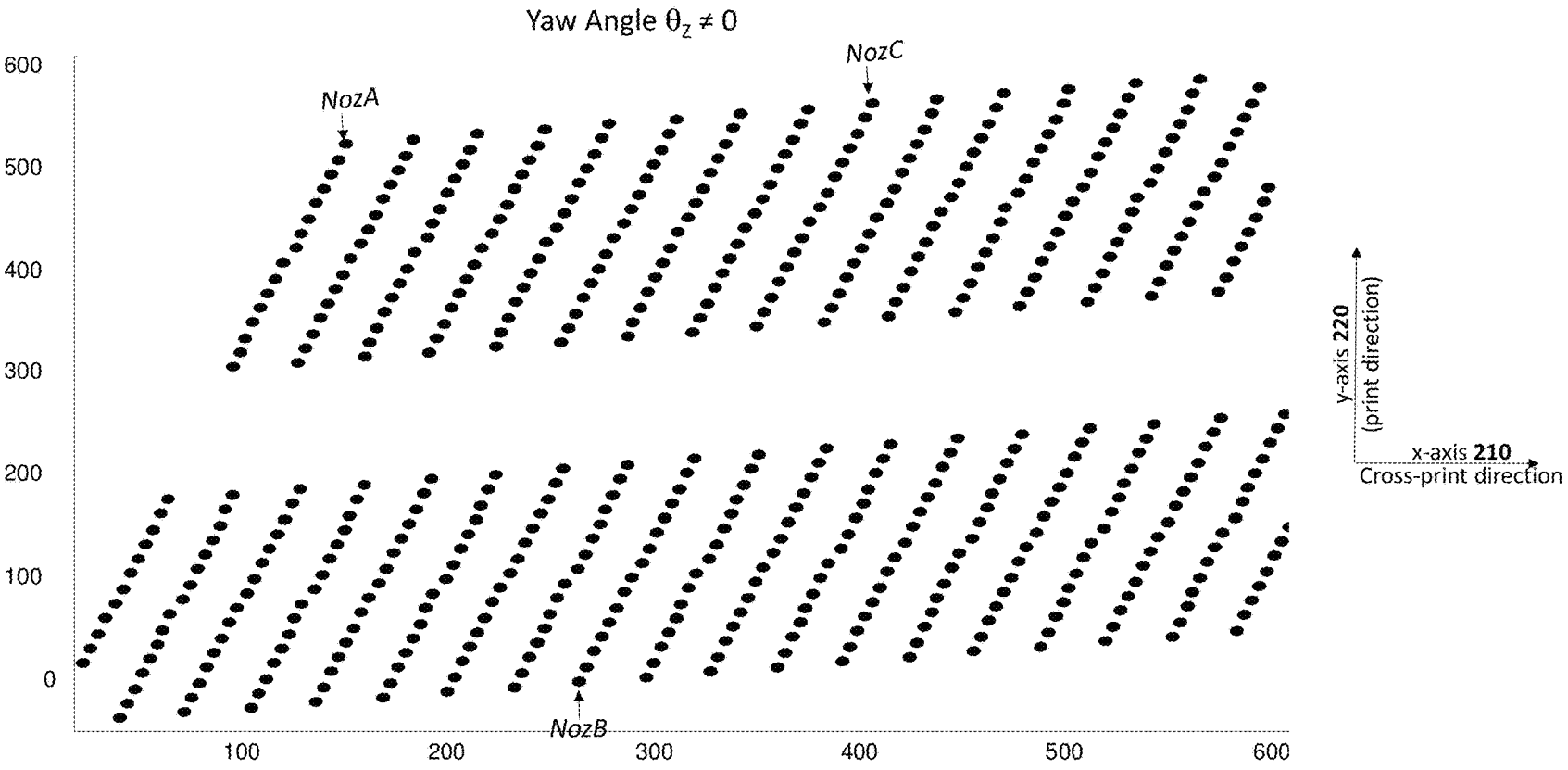

FIG. 5A illustrates nozzles of a print head in one example, where each dot represents a different nozzle. Shown in FIG. 5A are the cross-print direction (x-axis 210) and the print direction (y-axis 220)—each nozzle has a position in the print direction and in the cross print direction. FIG. 5A relates to the case where the Yaw angle $\theta_Z$ is zero—i.e. the 'ideal' situation. In FIG. 5B, the Yaw angle $\theta_Z$ is non-zero. As will be discussed in further detail in the following paragraphs, yaw-rotation of the print head 250 changes the displacement between nozzles along the cross-print direction.

A position of each nozzle, relative to the target surface, in FIGS. 5A-5B is defined by Cartesian coordinates. Thus, in FIG. 5A, a position of nozzle NozA is $(NozA_X, NozA_Y)$, a position of nozzle NozB is $(NozB_X, NozB_Y)$, and a position of nozzle NozC is $(NozC_X, NozC_Y)$. In FIG. 5B, the nozzles are rotated relative to FIG. 5A, due to the non-zero Yaw angle $\theta_Z \neq 0$. In FIG. 5B, a position of nozzle NozA is $(NozA_{X'}, NozA_{Y'})$, a position of nozzle NozB is $(NozB_{X'}, NozB_{Y'})$, and a position of nozzle NozC is $(NozC_{X'}, NozC_{Y'})$.

Figure 6:
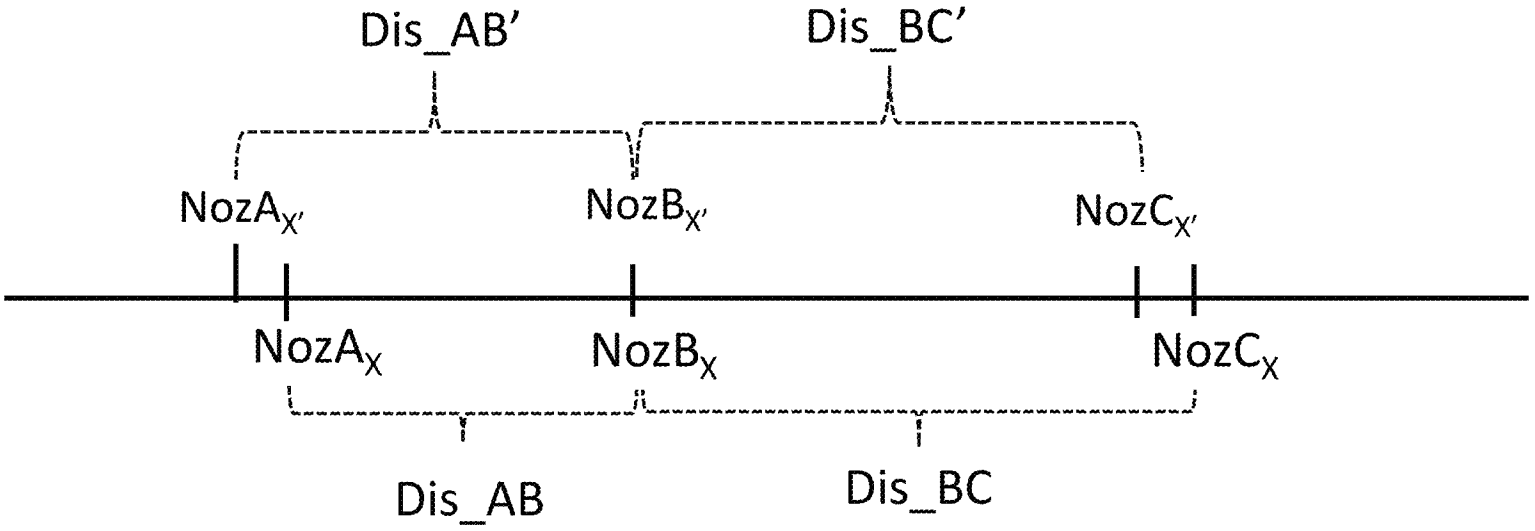
FIG. 6 illustrates example displacements between nozzles.

Reference is made to FIG. 6, which illustrates, for the zero yaw-angle situation of FIG. 5A: (i) a displacement Dis_AB in the cross-print direction between positions of nozzles NozA and NozB; (ii) a displacement Dis_BC in the cross-print direction between positions of nozzles NozB and NozC. The ratio between these displacements is $$Dis_RATIO = Dis_AB / Dis_BC.$$

FIG. 6 also illustrates, for the non-zero yaw-angle situation of FIG. 5B: (i) a displacement Dis_AB' in the cross-print direction between positions of nozzles NozA and NozB; (ii) a displacement Dis_BC' in the cross-print direction between positions of nozzles NozB and NozC. The ratio between these displacements is $$Dis_RATIO' = Dis_AB' / Dis_BC'.$$

Clearly, the displacement ratios are not equal, i.e. $Dis_RATIO \neq Dis_RATIO'$. Therefore, a non-zero yaw may introduce distortion into images printed by the nozzles.

Figure 7:
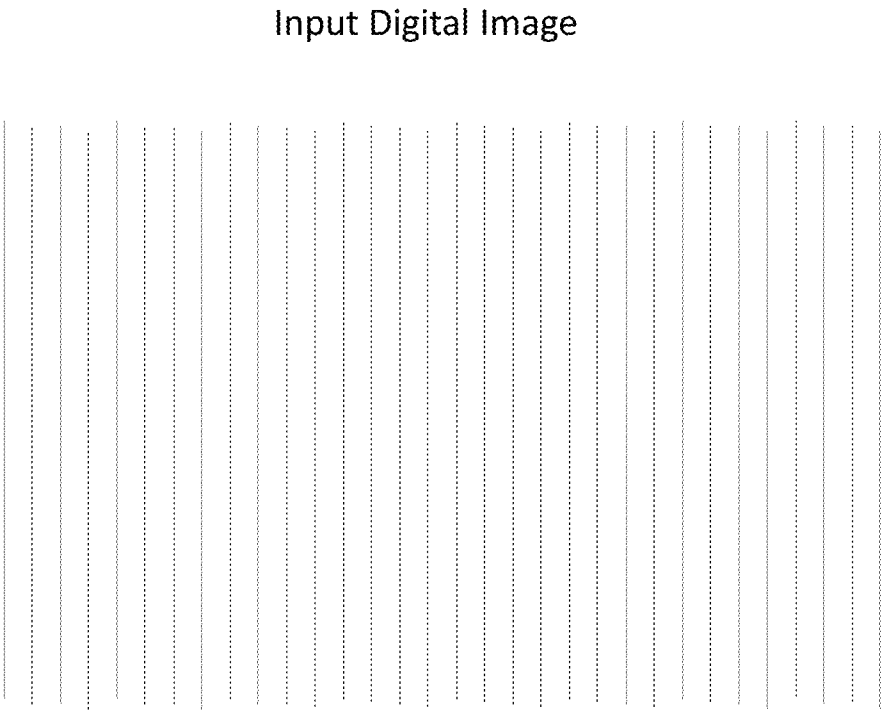
FIG. 7 illustrates an example of an input digital image that is defined as a series of parallel and equally-spaced lines.
Figure 8C:
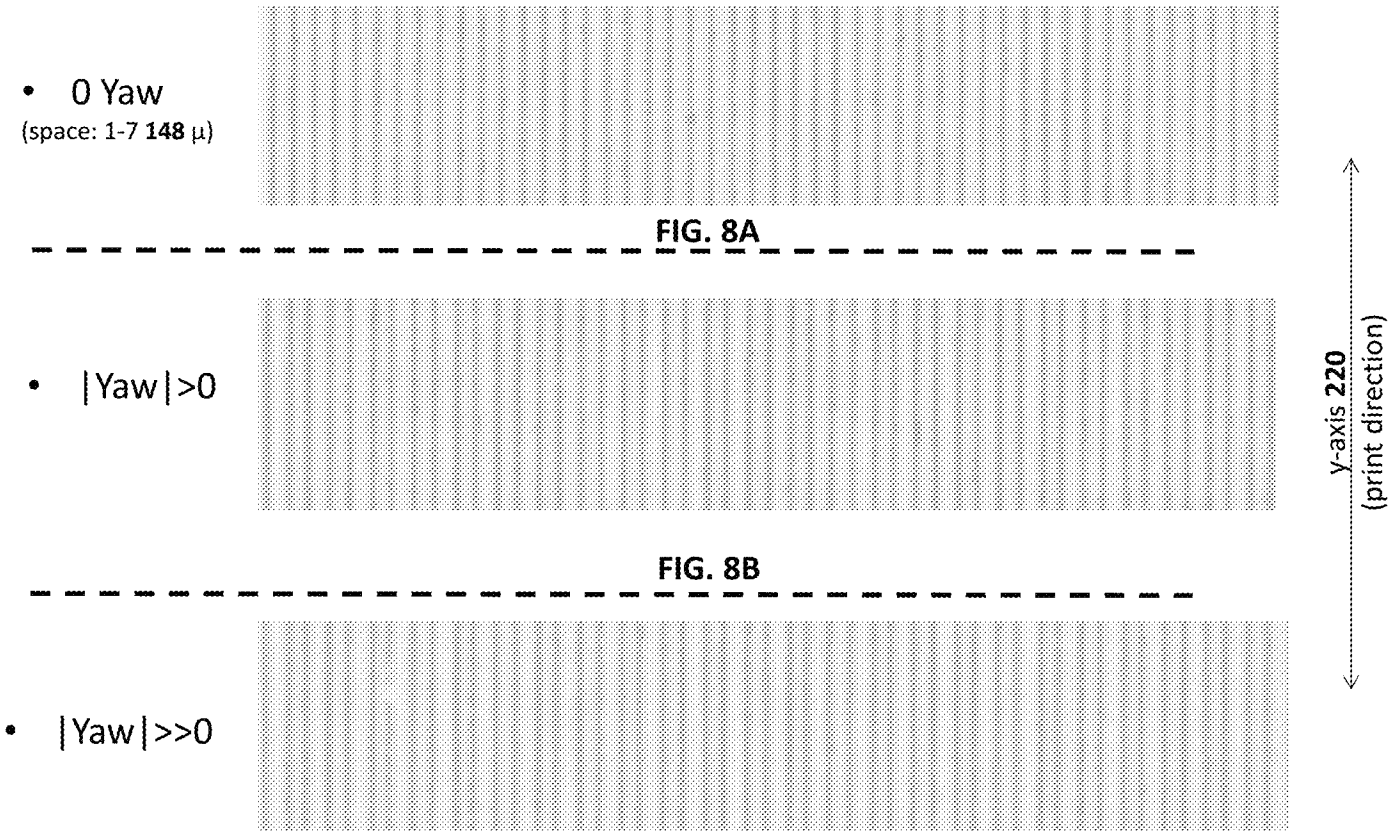

This distortion of the images is shown in FIGS. 7 and 8A-8C, where FIGS. 8B-8C show distortion relative to FIG. 8A. Each of FIGS. 8A-8B illustrates the resulting ink-image obtained by printing the same input digital image. This input digital image, illustrated in FIG. 7, is defined as a series of parallel and equally-spaced lines.

FIGS. 8A-8C show the resulting ink-image for the following three situations: (i) a first situation where the print bar is perfectly aligned with the cross-print direction (i.e. zero-yaw)—illustrated in FIG. 8A; (ii) a second situation where the print bar is misaligned according to a first yaw value $\theta^{FIRST}{}_Z$; and (iii) a third situation where the print bar is misaligned according to a second yaw value $\theta^{SECOND}{}_Z$. It is noted that the magnitude of the second yaw value exceeds the magnitude of the first yaw value—i.e. $|\theta^{FIRST}{}_Z| > |\theta^{SECOND}{}_Z|$.

In FIG. 8A, corresponding to zero-yaw, lines of the ink-image are equally spaced, similar to the situation of FIG. 7 (the input digital image). However, in the examples FIGS. 8B-8C, the non-zero yaw yields a non-uniform spacing in the ink-image, causing a distortion relative to the input digital image. In degree of distortion is greater in FIG. 8C than in FIG. 8B, corresponding to a greater yaw angle magnitude.

Figure 9:
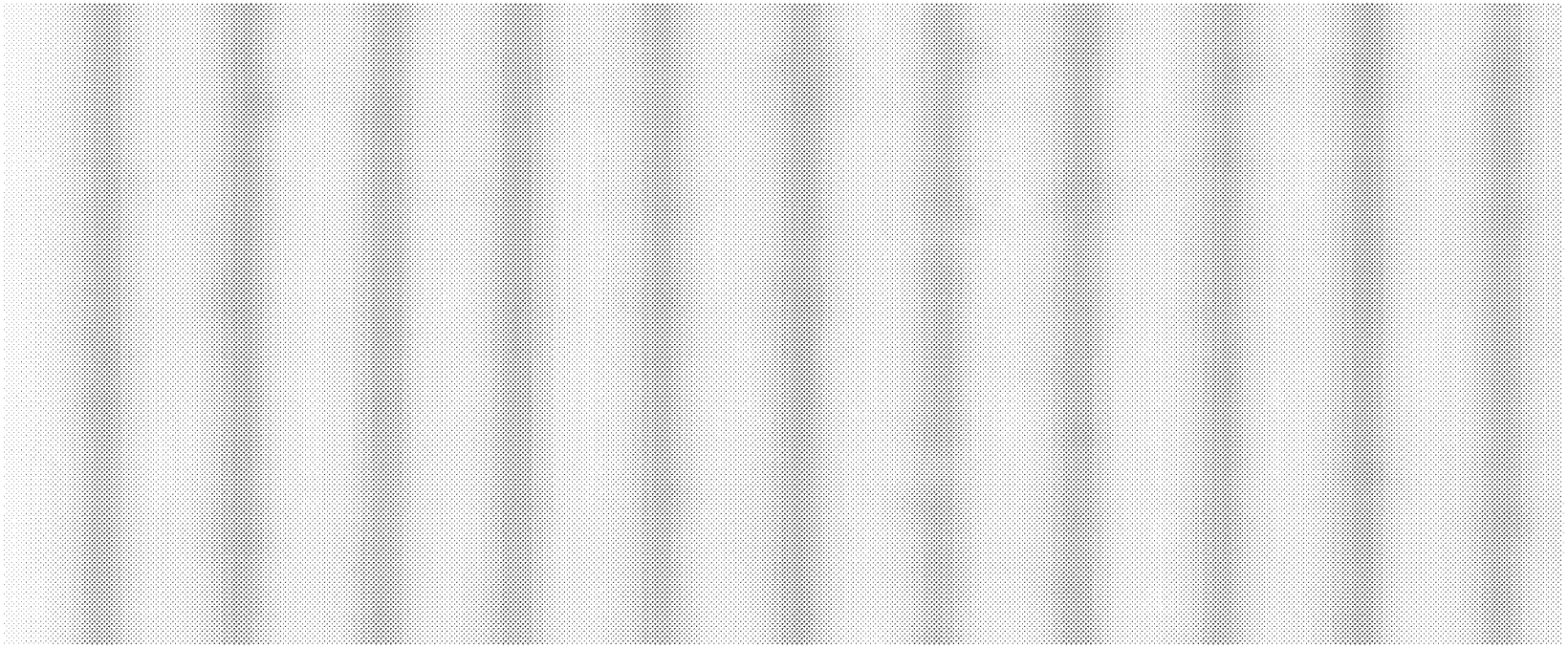
FIG. 9 is a close up of a portion of FIG. 8A.

FIG. 9 is a close up of a portion of FIG. 8A—as shown in FIG. 9, it is not always trivial to compute the location between the 'centers' of adjacent lines. In some embodiments, the presently-disclosed spectrum-based technique obviates the need to accurate detect the locations of centers when measuring a magnitude of the yaw angle.

Figure 10:
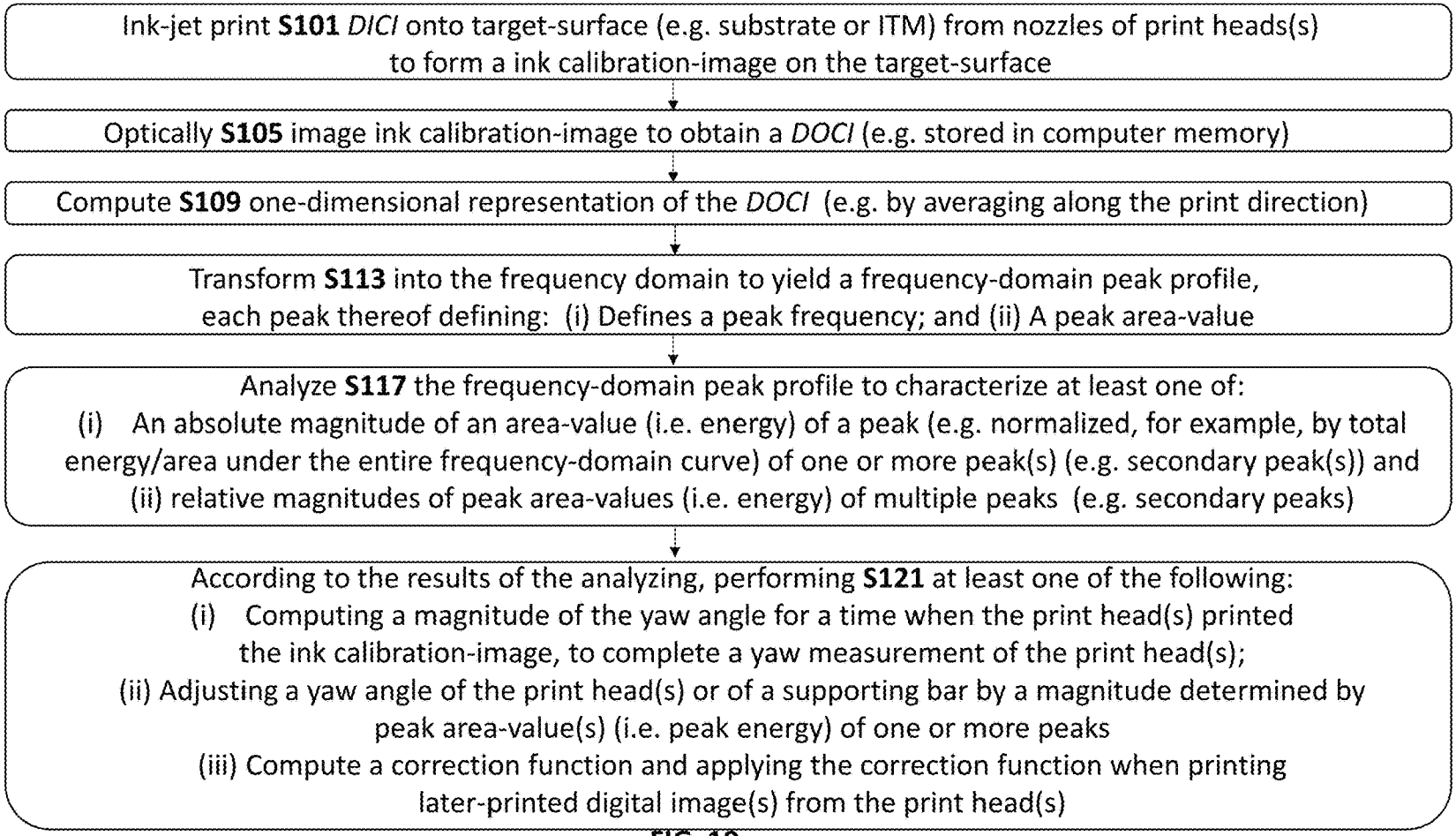
FIG. 10 is a flow chart of a method for measuring a magnitude of yaw according to some embodiments of the invention.

FIG. 10 is a flow chart of a method for measuring a magnitude of yaw according to some embodiments of the invention. In step S101, a first digital image (referred to as a 'calibration image'—the term 'calibration' is not intended as limiting) is printed onto a target-surface to form an ink image thereon. This ink image is optically imaged in step S105 (e.g. by camera, or scanner or in any other manner known in the art) to obtain a digital calibration output image (DOCI).

The DOCI may be stored in volatile and/or non-volatile computer memory or storage. In one example, the scanned digital image appears as in FIG. 9.

The DOCI is analyzed in steps S109-S113—e.g. by a digital computer. The DOCI is a two-dimensional digital image.

Figure 11:
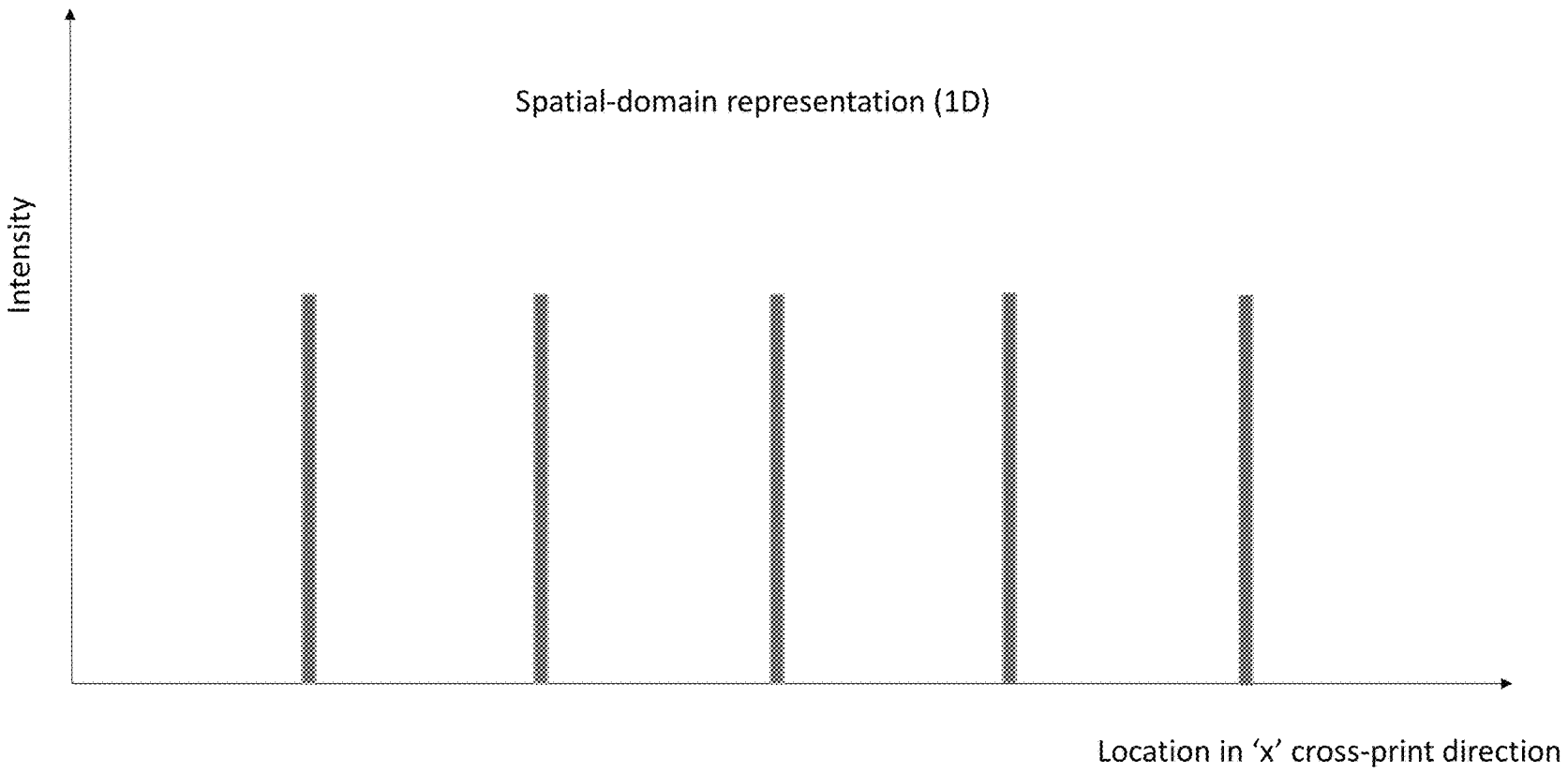
FIG. 11 illustrates, for the case of uniformly-spaced parallel lines, one example of the 1D spatial-domain representation of the digital calibration output image (DOCI).

In step S109, a one-dimensional representation of the above 2D-image is computed—e.g. by averaging along the print direction. The skilled artisan will appreciate that the term 'averaging' refers to any one dimensional statistical moment, including but not limited to a simple average, a weighted average, a mean, a median, and the like. FIG. 11 illustrates, for the case of uniformly-spaced parallel lines, one example of the 1D spatial-domain representation of the digital calibration output image (DOCI).

In step S113, this 1D representation is transformed from the spatial domain into the frequency domain—e.g. by Fast-Fourier-transformation (FFT). This transformation yields a power spectrum, which may subsequently be subjected to a spectral analysis in steps S117.

Figure 12A:
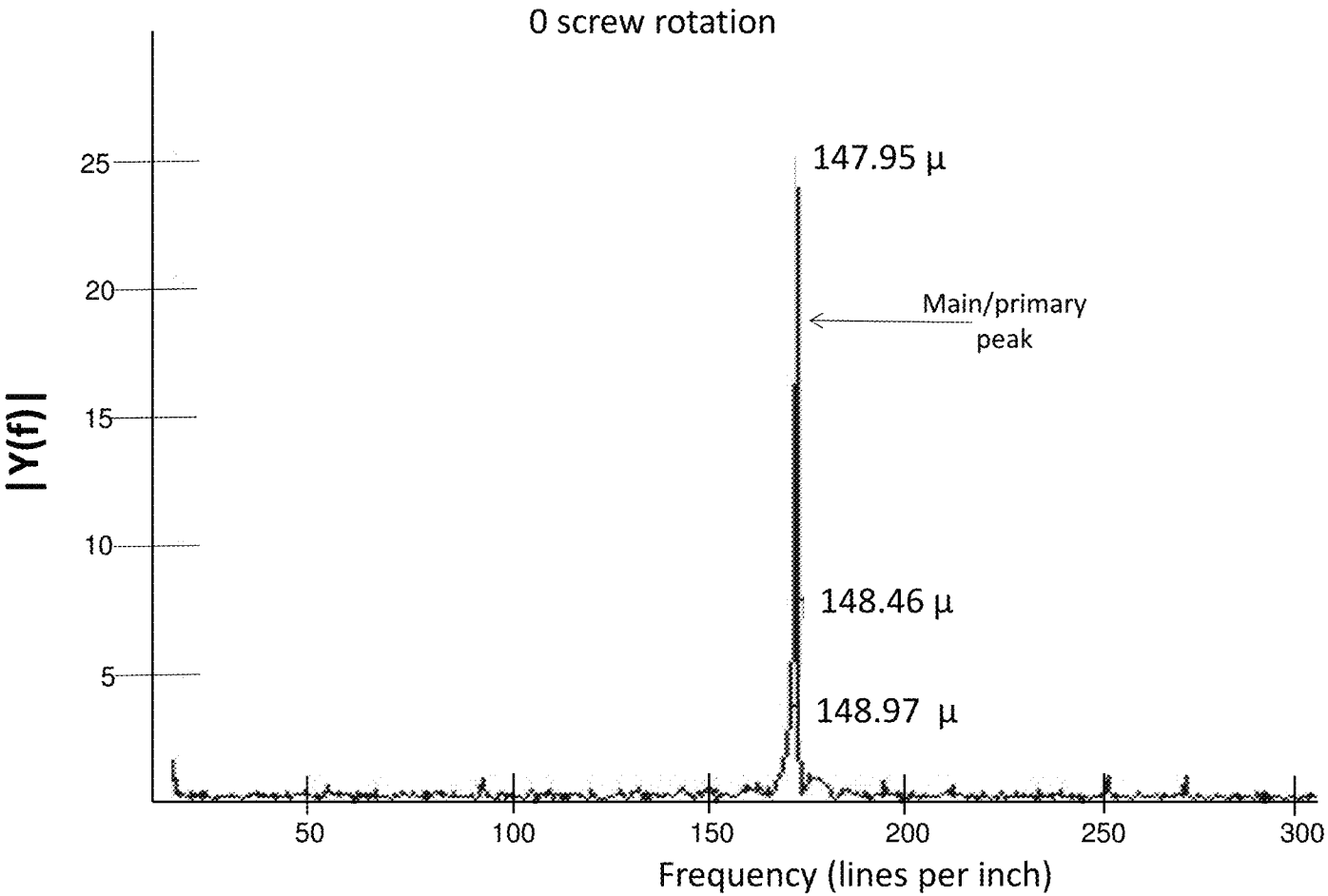
FIGS. 12A-12C illustrate power-spectra that respectively correspond to the ink-images of FIGS. 8A-8C.
Figure 12B:
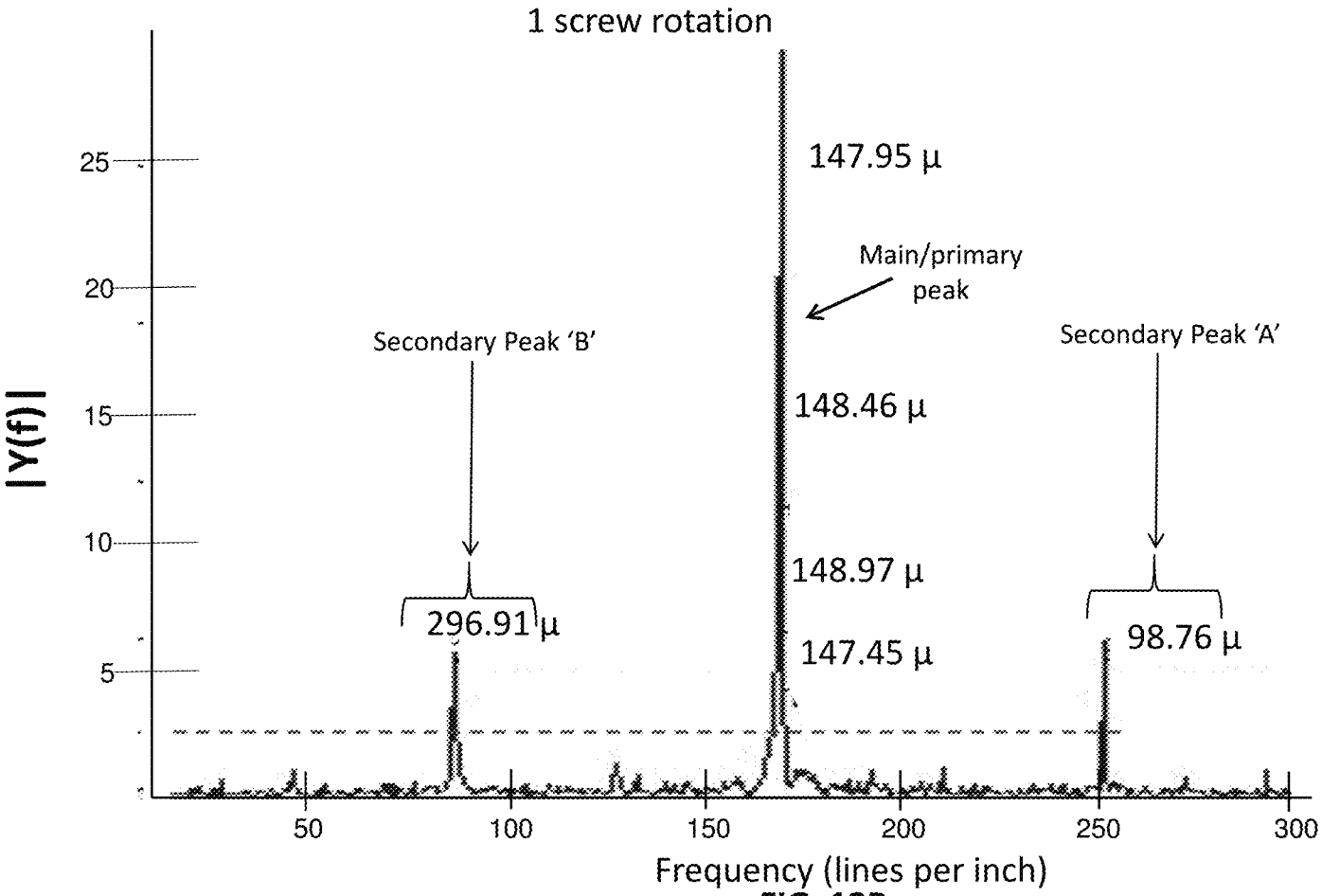
Figure 12C:
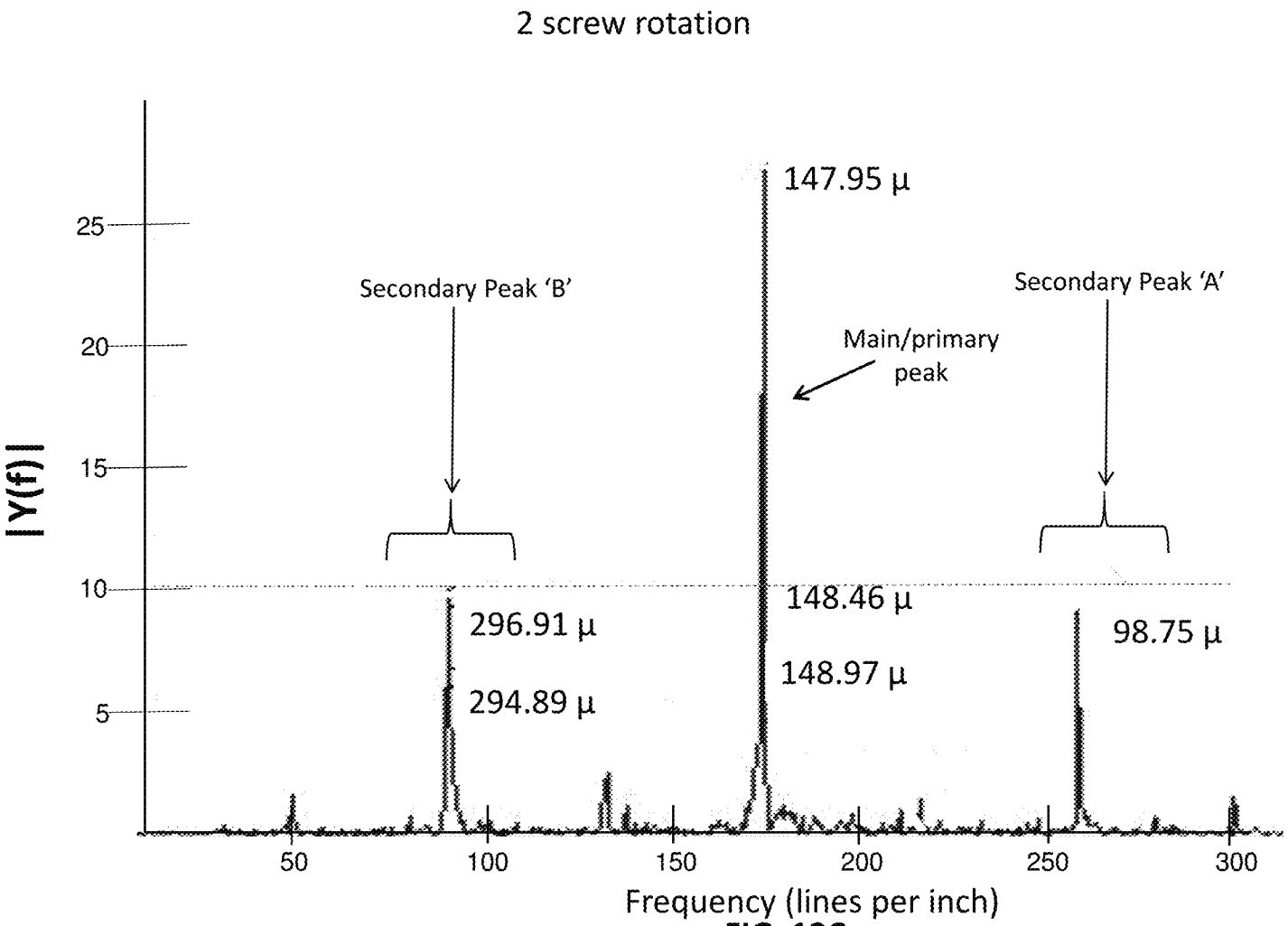

FIGS. 12A-12C illustrate power-spectra that respectively correspond to the ink-images of FIGS. 8A-8C. In particular, each peak may be analyzed to compute an area under the curve at and near the peak—this is referred to as a 'peak area-value' for the peak and corresponds to the energy per peak.

Thus, in the example of FIG. 12A (corresponding to the zero-yaw situation of FIG. 8A), substantially all energy of the power-spectrum resides in a single peak at a frequency of about 170 lines per inch—this 'primary' peak corresponds to line separation distances of 147.95μ. As will be seen below, the primary peak (i.e. which exists for zero-yaw) also exists for non-zero yaw situations, where secondary peaks are prominent as well.

As will be discussed below, the greater the deviation of the yaw angle from zero, the greater the energy of secondary peaks. Embodiments of the present invention relate to techniques where the yaw magnitude is measured by quantifying the energy of one or more of the secondary peaks.

In the discussion below, more than one secondary peak will be visible—either secondary peak (or a combination of both) may be used to measure a magnitude of the yaw angle.

Thus, the examples of FIG. 12B-12C correspond to situations where the yaw angle is non-zero—in contrast to the zero-yaw example of FIG. 12A where only a single primary peak is observed, in FIGS. 12B-12C , substantially all energy of the power-spectrum is split between three peaks—a main or primary peak at about 170 lines per inch, and two smaller secondary peaks respectively at about 95 lines per inch (secondary peak 'A') and about 260 lines per inch (secondary peak 'B'). This corresponds to a first non-zero yaw value (see FIG. 8B). Even though some energy resides in these secondary peaks, the relative amount of energy is low. The energy of each peak may be characterized by the area under the curve at the peak and this energy is correlated to magnitude of the yaw angle.

The example of FIG. 12C corresponds to a second non-zero yaw value (see FIG. 8C), a magnitude of which exceeds that of the first non-zero yaw values (see FIG. 8B). In the example FIG. 12C, the frequency of each of the two secondary peaks is substantially equal to the frequency of these peaks in the example of FIG. 12B. However, because the second yaw value (FIG. 12C) has a greater magnitude than the first yaw value (FIG. 12B), the energy of the secondary peaks is greater than in the example of FIG. 12B.

Thus, in step S117, when analyzing the frequency-domain peak profile it is possible to compute at least an absolute energy magnitude of at least one peak (for example, only the secondary peak at about 98.75μ or only the secondary peak at about 296.91μ), where a peak 'energy' is defined as the area beneath the curve of each peak. This absolute energy may be normalized (e.g. by the energy of the primary peak and/or by total area under the entire frequency-domain curve) to compute a 'normalized absolute energy'

Alternatively or additionally, it is possible to compute a relative energy magnitude of two or more peaks (e.g. characterized by ratio between energies of the two or more peaks).

For example, it is possible to compute an energy ratio between two or more peaks. Because this energy ratio is correlated with the magnitude of the yaw angle value, it is possible to measure a magnitude of the yaw angle by measuring the magnitudes of per-peak energy of one or more peaks (e.g. one or more secondary peaks) of the frequency-domain power spectrum. This may, for example, be performed for secondary peak A and/or for secondary peak B.

The applicant performed a computational simulation of printing a pre-determined model 'input' image for different yaw values for a pre-determined nozzle geometry (e.g. see FIGS. 5A-5B). In this simulation, the pre-determined model input image was like the input image of FIG. 7—a set of parallel lines that are uniformly spaced from each other. The simulation was performed for a plurality of 'input' yaw angle values—for each 'input' yaw value, the yaw-value-specific output image (i.e. the DOCI of step S105) was predicted, and then subjected to the analysis of steps S109-S117. Thus, for each input yaw value, the energy magnitude of secondary peak 'A' (see 'upper' curve of FIG. 13) and secondary peak 'B' (see 'lower' curve of FIG. 13) was computed according to the mathematical model. Thus, the two curves of FIG. 13 describe a relationship between predicted peak-energy value as a function of a magnitude of yaw value.

Figure 13:
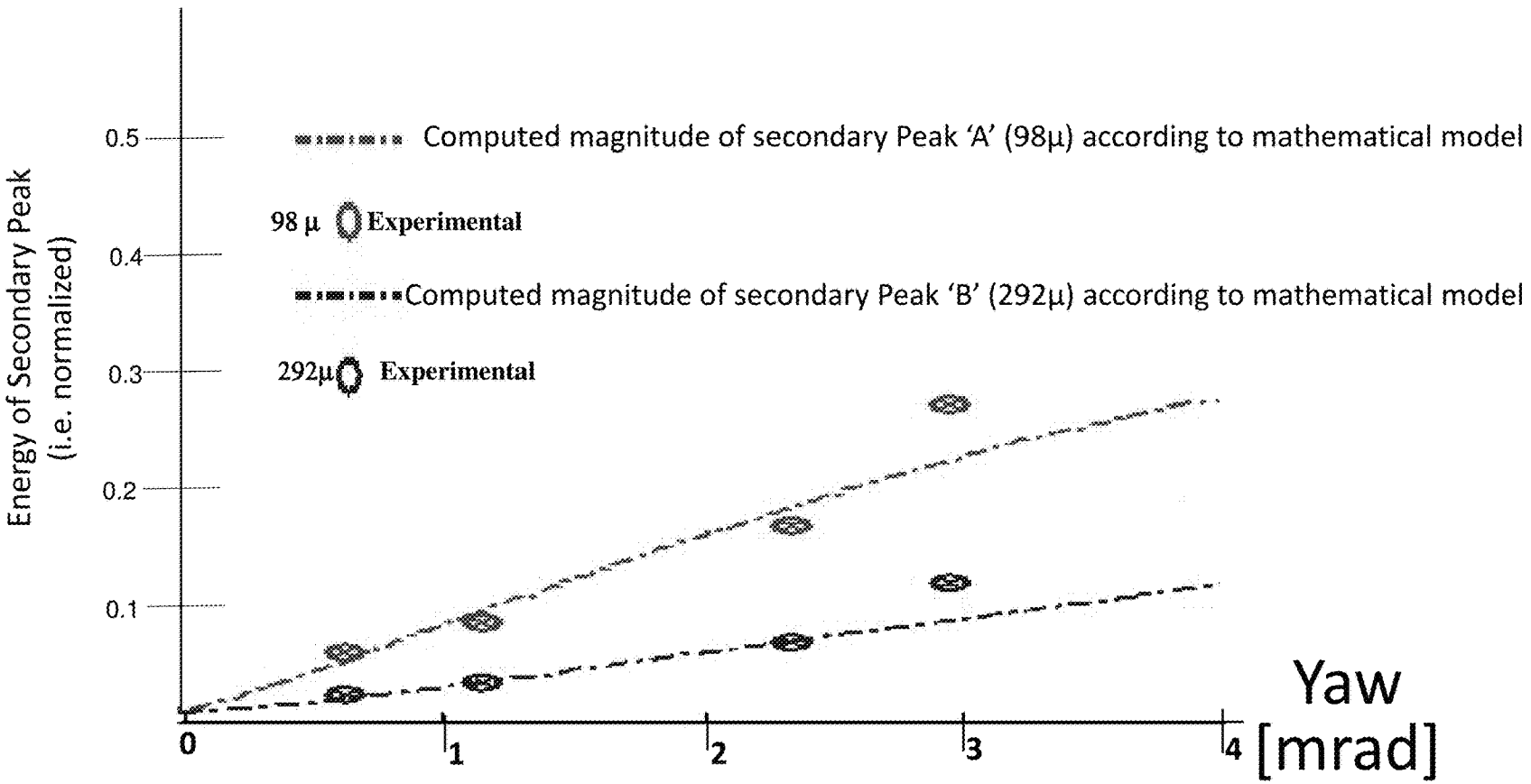
FIG. 13 shows examples of a "yaw:peak-energy correlation function."

The energies of FIG. 13 (y-axis) are 'normalized' energies—e.g. peak energy normalized by total energy of the entire spectrum.

Each of the curves of FIG. 13 are examples of a "yaw: peak-energy correlation function"—the 'upper curve' is a yaw:peak-energy correlation function for the secondary peak having a frequency of 98 microns and the lower curve is a yaw:peak-energy correlation function for the secondary peak having a frequency of 292 microns.

In addition to the numerical simulations used to generate the two curves of FIG. 13, physical experiments were performed where the yaw angle (i.e. of a 'physical print bar') was measured directly (x-axis) and also the peak energies were computed (e.g. according to the method of FIG. 10). In particular, for the aforementioned nozzle geometry (i.e. real-world print head(s) having the same nozzle geometry that was specified for the model/mathematical-simulations), the same input digital image as was used in the model was printed into a target surface for a plurality of yaw values. The resulting printed ink-images (i.e. one ink-image per yaw value) were each optically imaged so that a different DOCI was experimentally obtained for each yaw value. The DOCI images were then analyzed to compute therefrom (i) peak energies of secondary peak 'A' for a plurality of actual yaw values used to print the images (i.e. experimental data points scattered around the upper curve for secondary peak 'A'); and (ii) peak energies of secondary peak 'B' for a plurality of actual yaw values used to print the images (i.e. experimental data points scattered around the lower curve for secondary peak 'B').

As shown in FIG. 13, good agreement was found between the experimental data and the numerical modelling.

Reference is made, once again, to FIG. 8. In step S121 of FIG. 10, one or more of the following steps are performed according to the analysis: (i) computing a magnitude of the yaw angle for a time when the print head(s) printed the ink calibration-image (for example, according to a pre-computed correlation relation similar to that of FIG. 13); (ii) adjusting a yaw angle of print head(s) or of the print bar by a magnitude determined by the results of the analysis of step S117 (e.g. according to energies of one or more peaks); (iii) compute a correction function and applying the correction function when printing a later-printed digital image(s) from the print head(s)—for example, to reduce or eliminate image distortion such as that illustrated in FIG. 8B-8C.

Furthermore, step S121 may be performed according to a pre-computed correlation function between yaw magnitude and the secondary peak energy values and/or relations between energy values of distinct secondary peaks (e.g. an energy ratio between energies of two or more secondary peaks). FIG. 13 illustrates two pre-computed correlation functions. This pre-computed correlation function is typically specific for the geometric of nozzles in the print head(s) and depends upon (i.e. is a function of) the chosen lines spacing—the example correlation function of FIG. 13 is thus specific to the nozzle geometry of FIG. 5. Thus, the method of FIG. 10 may be performed to measure the magnitude of the yaw.

In some embodiments, the computing of the yaw value (or the adjusting of the yaw angle of the print head(s) (or supporting bar thereof) or the application of the correction function to reduce non-zero-yaw derived image distortion) is performed by analyzing relative magnitudes of energies of first and second secondary peaks—e.g. an energy ratio between energies of the first and second secondary peak.

Not wishing to be bound be by theory, in some embodiments, the techniques of one or more of steps S113-S121 may provide one or more of the following advantages: (i) reduce the computation time (or amount of computational resources required) to compute a magnitude of Yaw; (ii) increase an accuracy of a measurement of the Yaw angle; (iii) increase a 'sample size' of nozzles upon which a computation may be based (e.g. there is no need to restrict computation to nozzles that are uniformly spaced from each other)—as such, more nozzles may be used, increasing the nozzle sample size and providing a more robust computation technique; (iv) computing Yaw magnitude from an ink image that has not been magnified, or that has been magnified to a lesser extent (if at all) than would have been required in the absence of presently-disclosed techniques for measuring yaw angles.

Figure 14A:
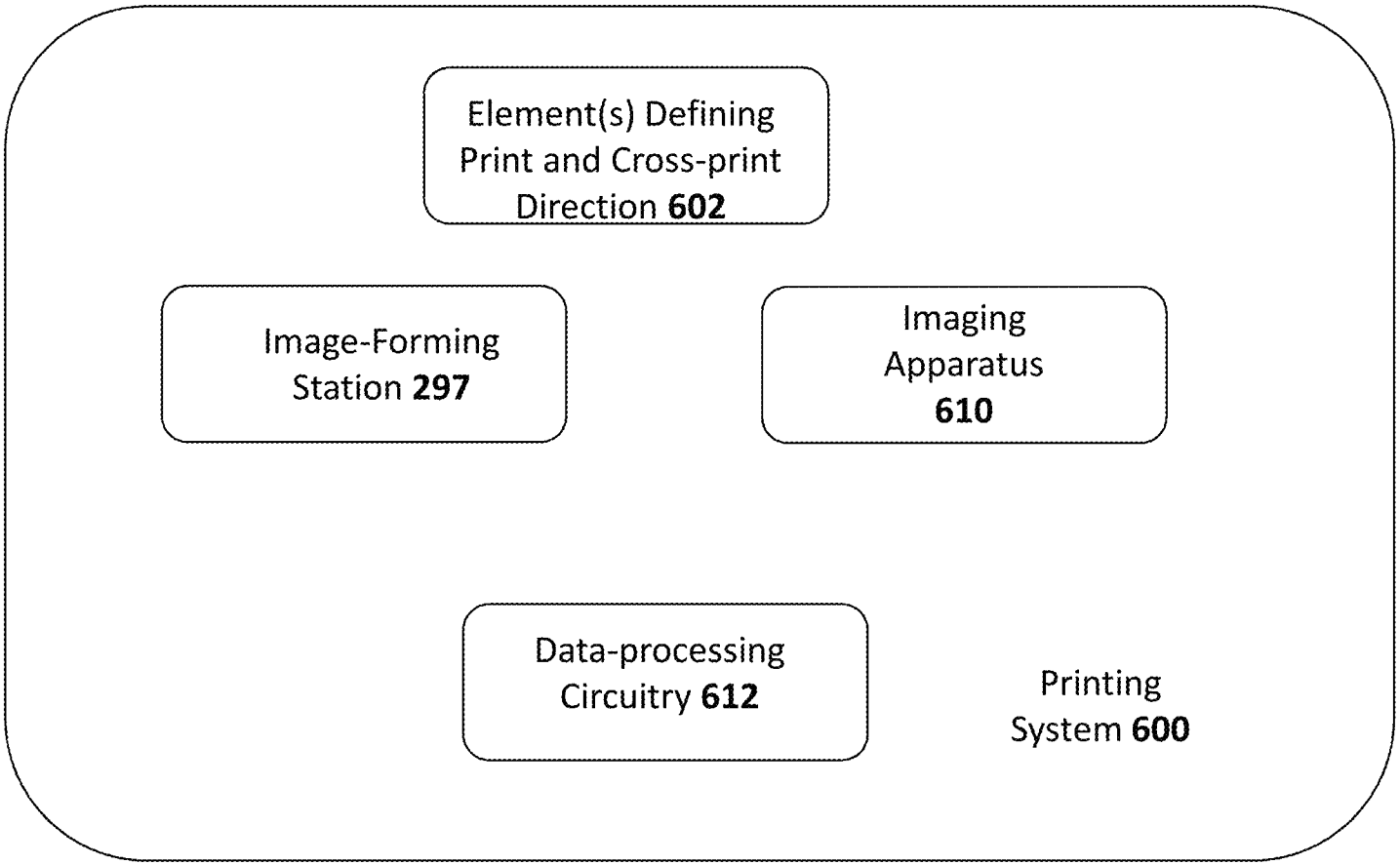
FIGS. 14A-14B illustrate exemplary printing systems configured to perform any method disclosed herein.
Figure 14B:
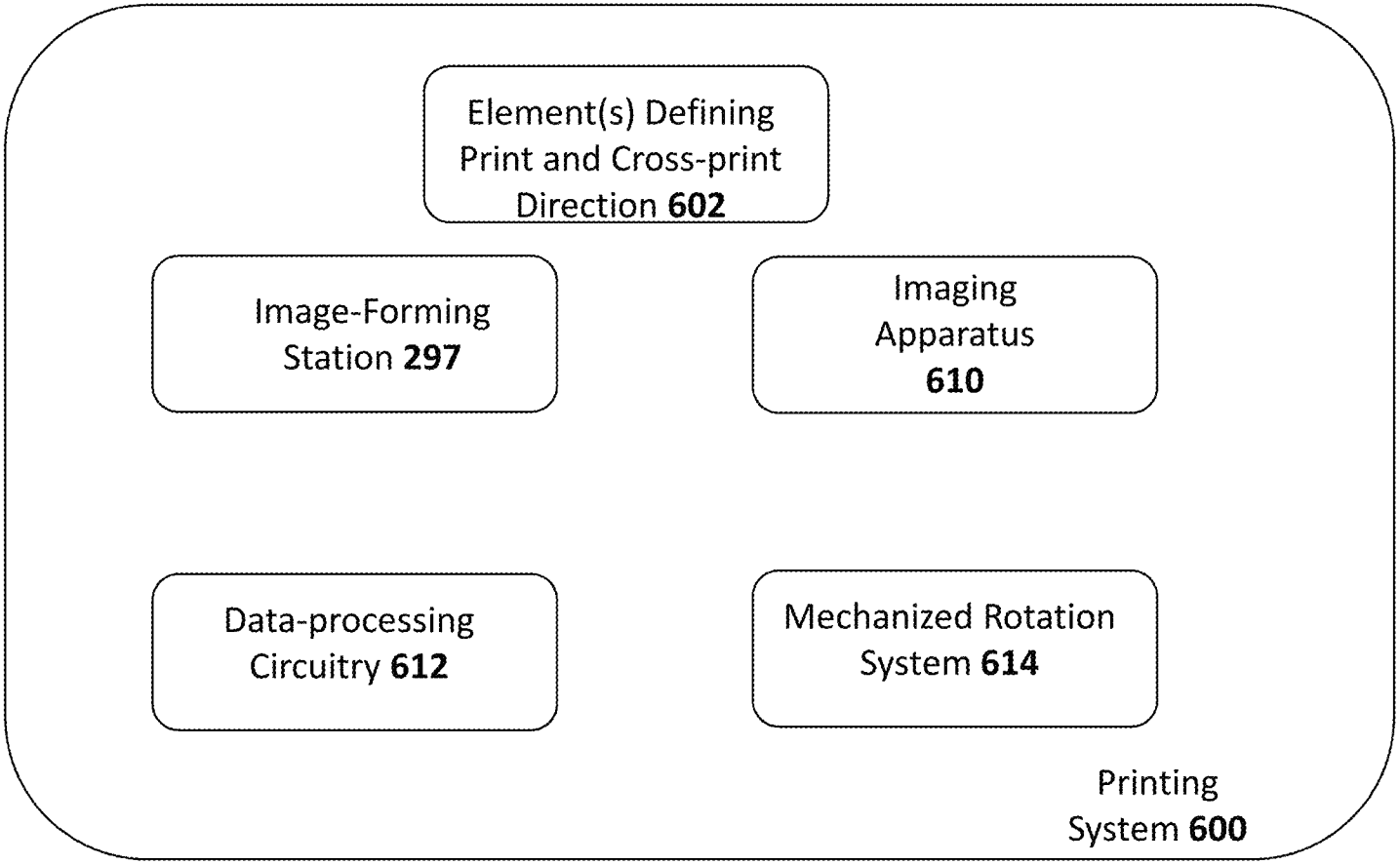

FIGS. 14A-14B illustrate exemplary printing systems 600 configured to perform any method disclosed herein. Each printing system includes: (i) one or more element(s) 602 defining print and cross-print directions (for example, at least one of (i) an intermediate transfer member (ITM) 102; (ii) a support thereof (e.g. one or more rollers over which a blanket ITM is mounted) and (iii) a substrate-transport system (STS) 524)); b. an image-forming station 297 comprising at least one print bar that is configured, when loaded with a print head, to deposit ink droplets onto a target surface to form a calibration image thereon, c. imaging apparatus (e.g. a camera or a scanner) 610 for optically imaging the calibration ink-image to acquire a 2D digital calibration image; d. data-processing circuitry 612 for: i. computing a 1D-representation (1D-rep) of the 2D digital calibration image by averaging the 2D digital calibration image in a pre-determined direction; ii. transforming the 1D-rep into a frequency domain representation characterized by a peak profile; and iii. analyzing the frequency domain representation to compute an energy magnitude(s) of one or more secondary peaks of the peak profile.

In some embodiments, the data-processing circuitry is further configured to and iv. compute a measured yaw angle magnitude from the energy magnitude(s) of the secondary peak(s).

In the present disclosure 'electronic circuitry' or 'data-processing circuitry' or 'control circuitry' 612 is intended broadly to describe any combination of hardware, software and/or firmware. Electronic circuitry or 'data-processing circuitry' or 'control circuitry' 612 may include may include any executable code module (i.e. stored on a computer-readable medium) and/or firmware and/or hardware element(s) including but not limited to field programmable logic array (FPLA) element(s), hard-wired logic element(s), field programmable gate array (FPGA) element(s), and application-specific integrated circuit (ASIC) element(s). Any instruction set architecture may be used including but not limited to reduced instruction set computer (RISC) architecture and/or complex instruction set computer (CISC) architecture. Electronic circuitry may be located in a single location or distributed among a plurality of locations where various circuitry elements may be in wired or wireless electronic communication with each other.

In the example of FIG. 14B, the system 600 further comprises a mechanized rotation system 614—e.g. for applying a torque to a print bar 302 or a print head 252 to modify $\theta^{PRINT_BAR}{}_Z$ of the print bar shown in FIG. 4A or $\theta^{PH_A}{}_Z$ shown in FIG. 4B. In some embodiments, mechanized rotation system 614 is responsive to output of the data-processing circuitry for automatically rotating the print bar 302 or loaded print head 252 by an adjustment angle that is computed, by the data-processing circuitry 612, from the energy magnitude(s) of the one or more secondary peak(s) (e.g. from the measured yaw angle magnitude).

In some embodiments, the mechanized rotation system 614 comprises at least one of an electrical motor and a servo.

In some embodiments, a target surface is selected from the group consisting of (i) an external surface of the ITM and (ii) substrate that is transported by the STS.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons skilled in the art to which the invention pertains.

In the description and claims of the present disclosure, each of the verbs, 'comprise' 'include' and 'have', and conjugates thereof, are used to indicate that the object or objects of the verb are not necessarily a complete listing of members, components, elements or parts of the subject or subjects of the verb. As used herein, the singular form 'a', an and the include plural references unless the context clearly dictates otherwise. For example, the term 'an image transfer station' or 'at least one image transfer station' may include a plurality of transfer stations.

In the description and claims of the present disclosure, each of the verbs, "comprise" "include" and "have", and conjugates thereof, are used to indicate that the object or objects of the verb are not necessarily a complete listing of members, components, elements or parts of the subject or subjects of the verb. As used herein, the singular form "a", "an" and "the" include plural references unless the context clearly dictates otherwise. For example, the term "a marking" or "at least one marking" may include a plurality of markings.

What is claimed is:

1. A method of measuring a magnitude of a yaw angle of print head(s) or of a supporting print-bar thereof relative to cross-print direction, the method comprising:

a. depositing ink droplets from print head(s) of the print-bar onto a target surface to form a calibration ink-image thereon;

b. optically imaging the calibration ink-image to acquire a 2D digital calibration image;

c. computing a 1D-representation (1D-rep) of the 2D digital calibration image by averaging the 2D digital calibration image in a pre-determined direction;

d. transforming the 1D-rep into a frequency domain representation characterized by a peak profile;

e. analyzing the frequency domain representation to compute an energy magnitude(s) of one or more secondary peaks of the peak profile;

f. computing a measured yaw angle magnitude from the energy magnitude(s) of the secondary peak(s).

2. The method of claim 1 wherein the measured yaw angle magnitude is computed from the combination of (A) the energy magnitude(s) of the secondary peak(s) and (B) a yaw:peak-energy correlation function between yaw magnitudes and absolute or relative secondary peak energy values.

3. The method of claim 1 wherein the transforming of the 1D-rep into the frequency domain representation comprises subjecting the 1D-rep to a fast Fourier transformation (FFT).

4. The method of claim 1 wherein the pre-determined direction is the print direction.

5. The method of claim 1 wherein (i) a parameter describing relative energy-magnitudes of two or more secondary peaks is computed from the peak profile and (ii) the yaw angle magnitude is measured and/or the yaw of the print head is adjusted according to the parameter describing the relative energy-magnitudes.

6. The method of claim 5 wherein the parameter describing the relative energy-magnitudes is a ratio between respective energies of first and second secondary peaks of the peak profile.

7. A method of measuring a magnitude of a yaw angle of print head(s) or of a supporting print-bar thereof relative to cross-print direction, the method comprising:

a. depositing ink droplets from print head(s) of the print-bar onto a target surface to form a calibration ink-image thereon;

b. optically imaging the calibration ink-image to acquire a 2D digital calibration image;

c. computing a 1D-representation (1D-rep) of the 2D digital calibration image by averaging the 2D digital calibration image in a pre-determined direction;

d. transforming the 1D-rep into a frequency domain representation characterized by a peak profile;

e. analyzing the frequency domain representation to compute an energy magnitude(s) of one or more secondary peaks of the peak profile;

f. adjusting a yaw of the print head or of a supporting print bar thereof by an adjustment angle that is computed from the energy magnitude(s) of the one of more secondary peak(s).

8. The method of claim 7 wherein the adjustment angle by which the print head or print bar is adjusted is computed from the combination of the (A) the energy magnitude(s) of the secondary peak(s) and (B) the yaw:peak-energy correlation function.

9. The method of claim 7 wherein a measured yaw angle magnitude is computed from the energy magnitude(s) of the secondary peak(s), and the adjustment angle is computed to have a magnitude matching the measured yaw angle magnitude.

10. The method of claim 7 wherein the transforming of the 1D-rep into the frequency domain representation comprises subjecting the 1D-rep to a fast Fourier transformation (FFT).

11. The method of claim 7 wherein (i) a parameter describing relative energy-magnitudes of two or more secondary peaks is computed from the peak profile and (ii) the yaw angle magnitude is measured and/or the yaw of the print head is adjusted according to the parameter describing the relative energy-magnitudes.

12. The method of claim 11 wherein the parameter describing the relative energy-magnitudes is a ratio between respective energies of first and second secondary peaks of the peak profile.

13. The method of claim 7 wherein the calibration ink-image is formed by printing a digital input image comprising a plurality of parallel lines.

14. The method of claim 7 wherein the pre-determined direction is the print direction.

15. The method of claim 7 wherein the calibration ink-image is optically imaged on the target surface.

16. The method of claim 7 wherein the calibration ink-image is optically imaged after being transferred away from the target surface.

17. A printing system comprising:

a. at least one of (i) an intermediate transfer member (ITM); (ii) a support thereof and (iii) a substrate-transport system (STS), the ITM or support thereof or the STS defining print and cross-print directions for the printing system;

b. an image-forming station comprising at least one print bar that is configured, when loaded with a print head, to deposit ink droplets onto a target surface to form a calibration image thereon, c. imaging apparatus for optically imaging the calibration ink-image to acquire a 2D digital calibration image;

d. data-processing circuitry for:

i. computing a 1D-representation (1D-rep) of the 2D digital calibration image by averaging the 2D digital calibration image in a pre-determined direction;

ii. transforming the 1D-rep into a frequency domain representation characterized by a peak profile;

iii. analyzing the frequency domain representation to compute an energy magnitude(s) of one or more secondary peaks of the peak profile; and iv. computing a measured yaw angle magnitude from the energy magnitude(s) of the secondary peak(s).

18. The system of claim 17 further comprising:

a mechanized rotation system responsive to output of the data-processing circuitry for automatically rotating the print bar or loaded print head by an adjustment angle whose magnitude equals the computed measured yaw magnitude.

19. The system of claim 18 wherein the mechanized rotation system comprises at least one of an electrical motor and a servo.

20. The system of claim 17, wherein the target surface is selected from the group consisting of (i) an external surface of the ITM and (ii) substrate that is transported by the STS.

* * * * *